US012708209B2

(12) United States Patent
Browne

(10) Patent No.: US 12,708,209 B2
(45) Date of Patent: Aug. 18, 2026

(54) CHAIR ASSEMBLY WITH CONNECTION DEVICES AND RELATED METHODS

(71) Applicant: ATLeisure, LLC, Atlanta, GA (US)

(72) Inventor: William Martin Browne, Atlanta, GA (US)

(73) Assignee: ATLEISURE, LLC, Atlanta, GA (US)

( * ) Notice: Subject to any disclaimer, the term of this patent is extended or adjusted under 35 U.S.C. 154(b) by 144 days.

(21) Appl. No.: 18/739,764

(22) Filed: Jun. 11, 2024

(65) Prior Publication Data

US 2024/0415285 A1 Dec. 19, 2024

Related U.S. Application Data

(60) Provisional application No. 63/517,708, filed on Aug. 4, 2023, provisional application No. 63/508,400, filed on Jun. 15, 2023.

(51) Int. Cl.
*A47C 4/02* (2006.01)

(52) U.S. Cl.
CPC ..... *A47C 4/021* (2013.01)

(58) Field of Classification Search
CPC ..... A47C 4/021; A47C 4/024; A47C 4/028; A47C 4/03; F16B 2200/69; F16B 2200/20; F16B 2200/205; F16B 12/34; F16B 12/36; F16B 12/38; F16B 12/52
USPC ..... 297/440.23, 440.21
See application file for complete search history.

(56) References Cited

U.S. PATENT DOCUMENTS

| | | | | |
|---|---|---|---|---|
| 2,550,361 | A * | 4/1951 | Lofgren | A47C 4/02 297/440.23 |
| 2,650,657 | A * | 9/1953 | Ohlsson | A47C 1/024 5/299 |
| 3,045,834 | A * | 7/1962 | Seiz | A47B 47/03 211/182 |
| 3,973,800 | A * | 8/1976 | Kogan | A47C 7/002 297/135 |
| 4,209,198 | A * | 6/1980 | Apple, Sr. | A47C 4/02 297/448.1 |
| 4,348,052 | A * | 9/1982 | Roland | A47C 3/029 297/440.13 |
| 5,387,027 | A | 2/1995 | Maloney | |
| 9,615,663 | B2 | 4/2017 | Davis | |
| 9,820,576 | B2 | 11/2017 | McCullough | |
| 10,138,917 | B2 | 11/2018 | Koch | |
| 10,202,993 | B2 | 2/2019 | Koelling et al. | |
| 10,823,214 | B2 | 11/2020 | Davis et al. | |

(Continued)

FOREIGN PATENT DOCUMENTS

EP 2752129 2/2018

*Primary Examiner* — Cassandra Davis
(74) *Attorney, Agent, or Firm* — Allen, Dyer, Doppelt + Gilchrist, PA

(57) ABSTRACT

A chair assembly includes first and second arm rests, a backboard, a pair of first connection devices coupling the backboard between the first and second arm rests, a seat board, and a pair of second connection devices coupling the seat board between the first and second arm rests. Each first connection device includes a first L-shaped anchor, a second transverse anchor, and first and second openings opposite to and receiving the first L-shaped anchor and the second transverse anchor for coupling. Each second connection device includes a third L-shaped anchor, and a third opening opposite to and receiving the third L-shaped anchor for coupling.

20 Claims, 23 Drawing Sheets

(56) References Cited

U.S. PATENT DOCUMENTS

| | | | | |
|---|---|---|---|---|
| 10,893,756 | B1 | 1/2021 | Neuenswander | |
| 10,968,936 | B2 | 4/2021 | Boo et al. | |
| 11,154,137 | B2 * | 10/2021 | Davis | A47C 4/021 |
| 2012/0080910 | A1 * | 4/2012 | Davis | F16B 12/10 211/186 |
| 2019/0085886 | A1 | 3/2019 | Davis et al. | |
| 2020/0196751 | A1 * | 6/2020 | Wong | A47B 85/04 |

* cited by examiner

CHAIR ASSEMBLY WITH CONNECTION DEVICES AND RELATED METHODS

RELATED APPLICATION

This application is based upon prior filed Application No. 63/508,400 filed Jun. 15, 2023 and prior filed Application No. 63/517,708 filed Aug. 4, 2023, the entire subject matter of which is incorporated herein by reference in its entirety.

TECHNICAL FIELD

The present disclosure relates to the field of furniture, and, more particularly, to furniture frames and related methods.

BACKGROUND

Many existing furniture pieces, especially in the case of increasing e-commerce applications, are often shipped in a dissembled state in separate packages. The users must then subsequently assemble the furniture pieces, and typically use screw type fasteners during the assembly. These approaches may have complicated assembly instructions, and may even require special tools for assembly, for example, power tools and specialty Allen wrenches.

In particular, e-commerce applicable approaches for chairs may have additional drawbacks. Typically, for chairs, the seat board, due to long-term use, receives a mutual shear force between the seat board and armrest components. This may cause fasteners to loosen during prolonged use. Further, in these approaches, disassembly of the chair may permanently affect structural strength of the fasteners.

SUMMARY

Generally, a chair assembly includes first and second arm rests, a backboard, a pair of first connection devices coupling the backboard between the first and second arm rests, a seat board, and a pair of second connection devices coupling the seat board between the first and second arm rests. Each first connection device comprises a first L-shaped anchor, a second transverse anchor, and first and second openings opposite to and receiving the first L-shaped anchor and the second transverse anchor for coupling. Each second connection device comprises a third L-shaped anchor, and a third opening opposite to and receiving the third L-shaped anchor for coupling.

In particular, the first L-shaped anchor may be canted at an angle with respect to the first and second arm rests and the backboard. For example, the angle may be less than 15° (i.e., an oblique angle). In some embodiments, the second transverse anchor may comprise a snap fastener. In other embodiments, the second transverse anchor may include an elongate anchor extending through one of the first and second arm rests and the backboard. The second transverse anchor may comprise a housing coupled to one of the first and second arm rests and the backboard and receiving the elongate anchor. The elongate anchor may be L-shaped.

Also, the first opening and the third opening may each comprise an elongate opening, and the second opening may comprise a circle-shaped opening. The first and second arm rests, the backboard, and the seat board may be hollow.

Another aspect is directed to a method for making a chair assembly to be assembled by a user. The method comprises providing first and second arm rests and a backboard, forming a pair of first connection devices to be coupled between the backboard and the first and second arm rests, and providing a seat board. The method also includes forming a pair of second connection devices to be coupled between the seat board and the first and second arm rests. Each first connection device comprises a first L-shaped anchor, a second transverse anchor, and first and second openings opposite to and receiving the first L-shaped anchor and the second transverse anchor for coupling. Each second connection device comprises a third L-shaped anchor, and a third opening opposite to and receiving the third L-shaped anchor for coupling.

DETAILED DESCRIPTION

Figure 1:
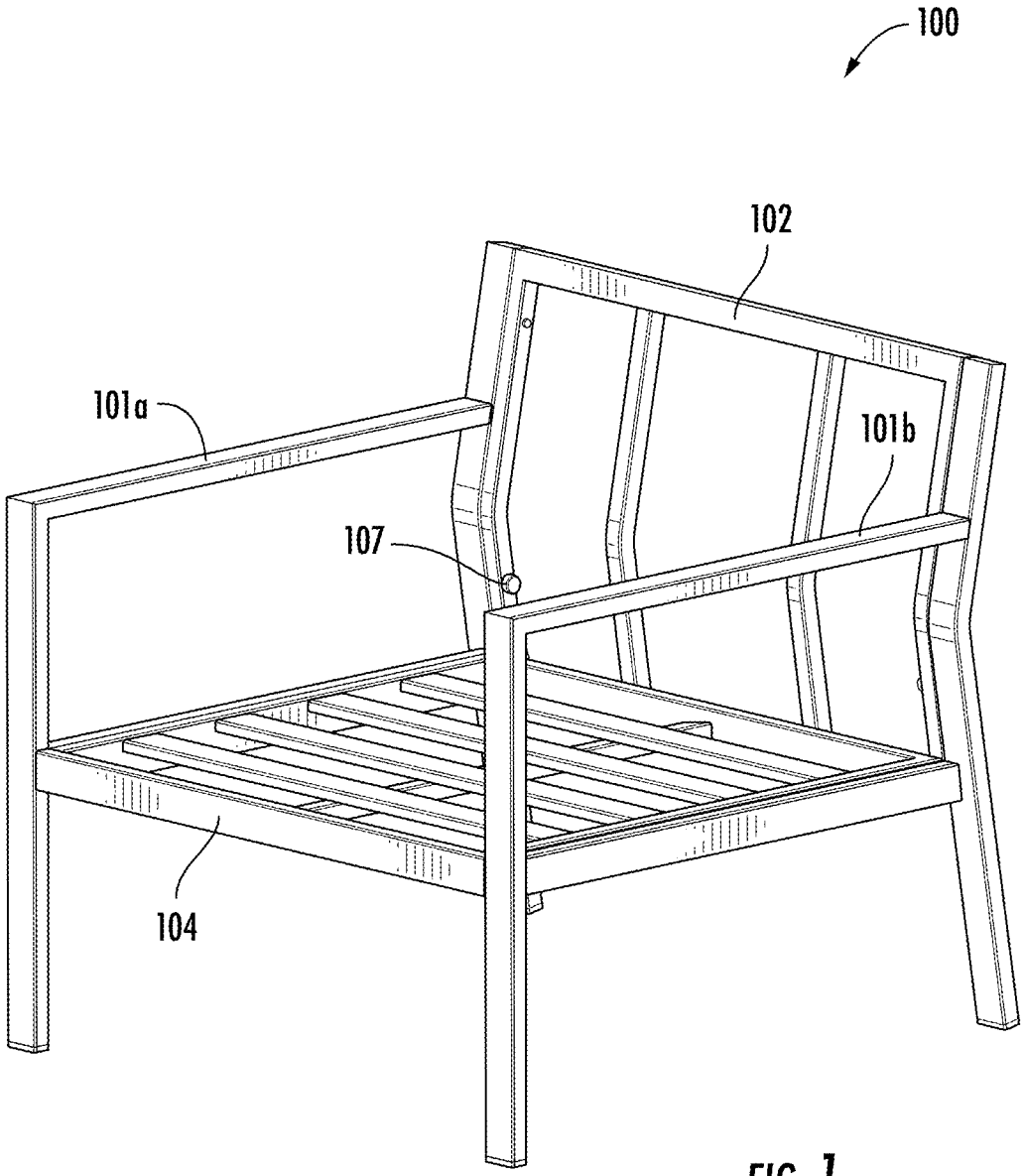
FIG. 1 is a perspective view of a first example embodiment of a chair assembly, according to the present disclosure.
Figure 2:
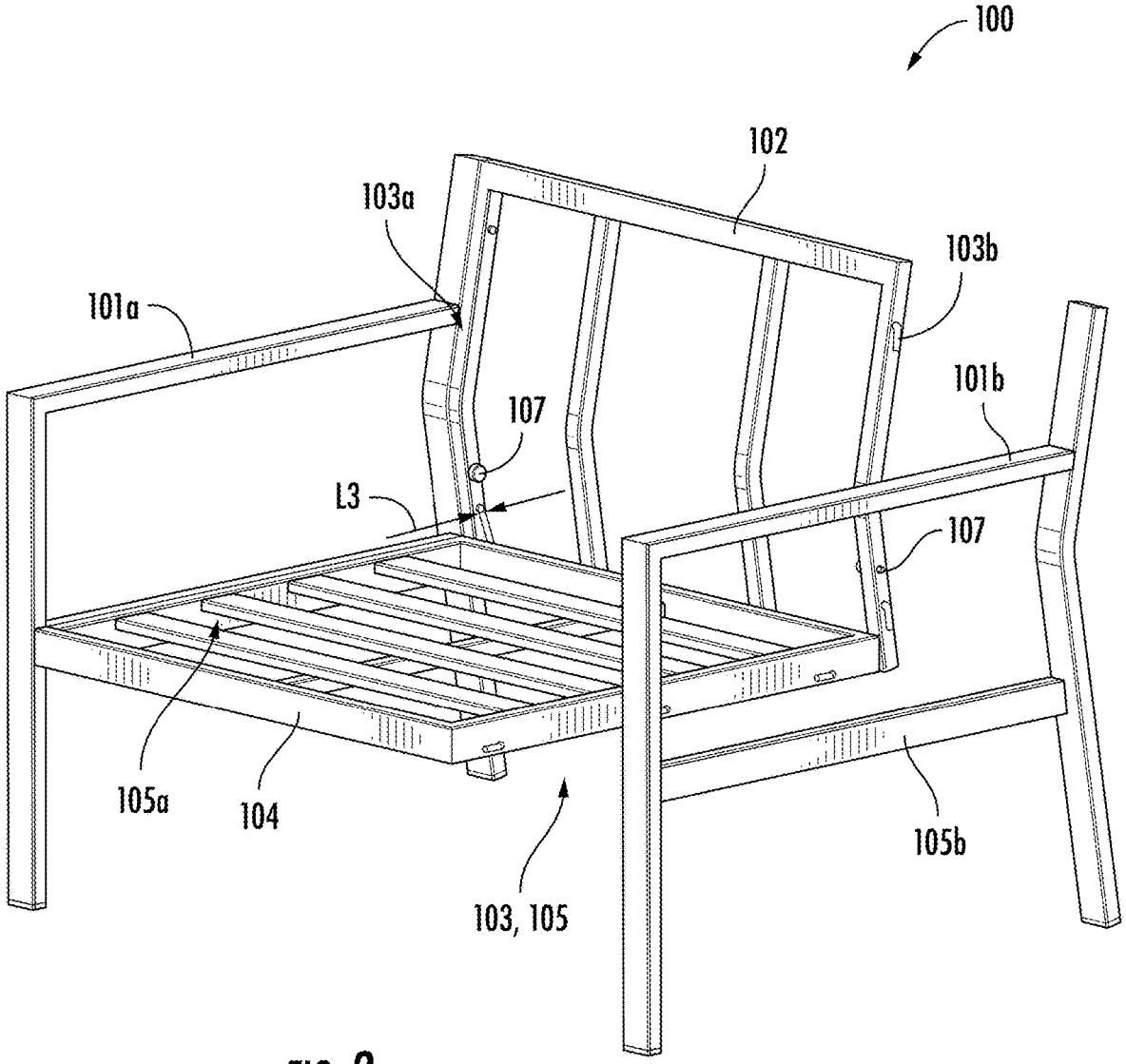
FIG. 2 is a partially exploded view of the chair assembly of FIG. 1.
Figure 3:
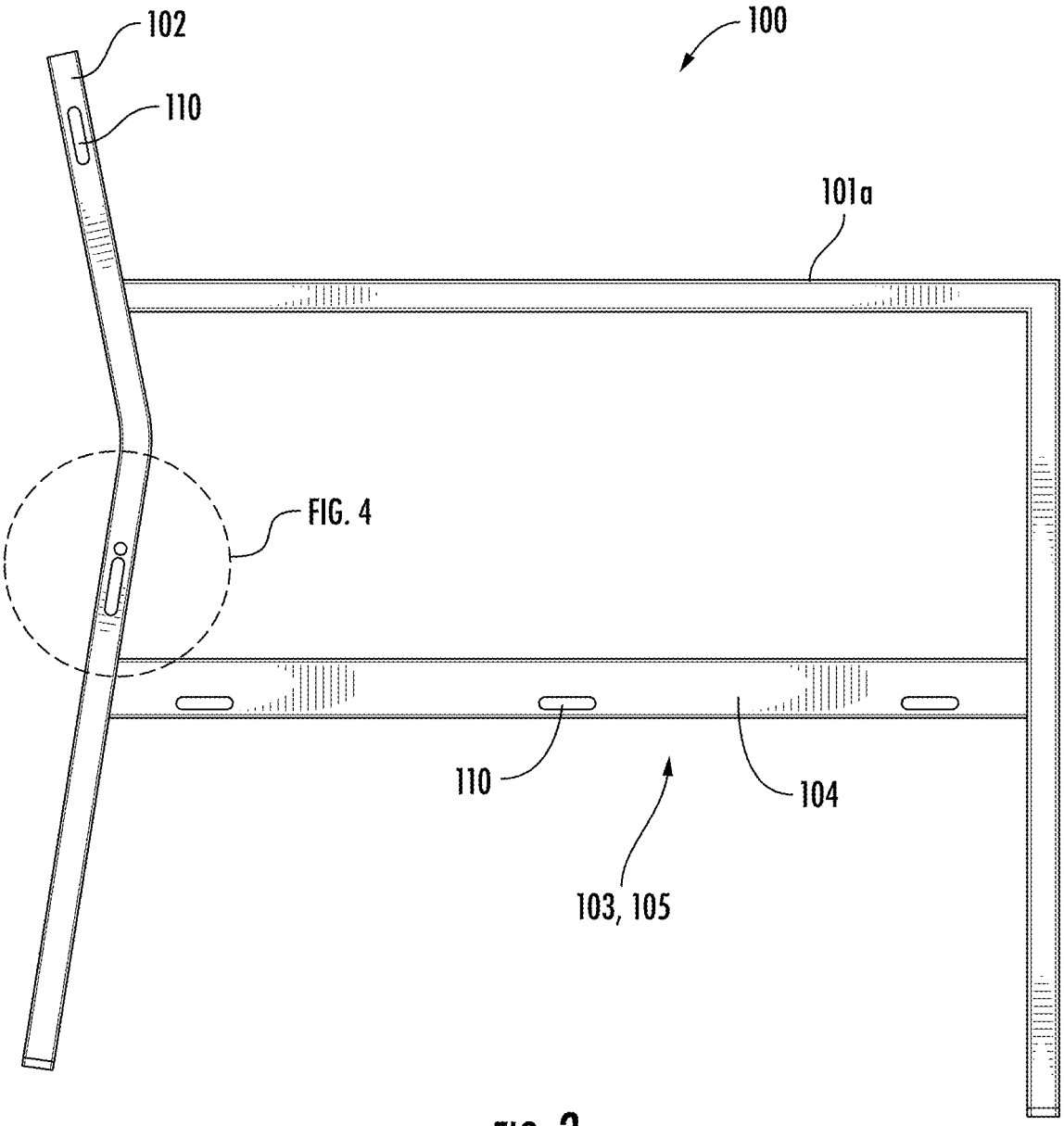
FIG. 3 is a side view of an arm rest from the chair assembly of FIG. 1.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Given the deficiencies of the existing approaches, the present application provides a connection structure, and a chair frame, which can provide an approach to the aforementioned problems. The technical approach is a connection structure. The connection structure comprises a first part, provided with at least one L-shaped connection piece. The L-shaped connection piece includes a fixed end and a snap-on end. The angle between the fixed end and the snap-on end being α (e.g., 90°<=α<100°). The snap-on end is provided along the length direction of the first part's surface. The closest distance between the snap end and the first surface distance is L1. The connection structure also includes a second part, with at least one opening. The snap part extending into the opening and sliding to the openings' bottom to complete the snap. The connection structure also includes a locking piece, passing through the first part and fixedly connected to the second part or passing through the second part and fixedly connected to the first part.

Furthermore, the second part is made of hollow material and has a wall thickness of e; and where L1<=e. The distance between the centers of the semicircles at the openings ends is L2, and the length of the snap-on part is L3; L2>=L3. The diameter of the semicircle at both ends of the opening is d1, and the thickness of the L-shaped connecting piece is d2; d1>=d2.

Also, the first part is provided with a first through-hole, and the second part is provided with a first connection hole correspondingly. The locking piece passes through the first through-hole and locks in conjunction with the first connection hole. The second part is provided with a second through-hole, and the first part is provided with a second connection hole. The locking piece passes through the second through-hole and locks in conjunction with the second connection hole.

A chair frame includes a chair frame body and a connection structure. The chair frame body includes a seat board, a backboard, and an armrest assembly. The armrest assembly is set opposite to each other, and the seat board and backrest are respectively set between the armrest assembly and the connection structure.

Furthermore, the backboard and seat board are described as the first part, and the armrest assembly is described as the second part. The seat board is provided with various L-shaped connections to cooperate with the several openings correspondingly provided on the armrest assembly. The backboard is provided with several L-shaped connections to cooperate with the numerous openings correspondingly provided on the armrest assembly, and the locking piece is fixedly connected to the armrest assembly through the backboard. Furthermore, the backboard is provided at the rear of the seat board. The seat board provides lateral restriction, and the locking piece is provided to offer longitudinal restriction for the backboard.

The benefits of the present application are, for example: 1. by the L-shaped connection piece and the opening from the snap, the two parts complete the restriction in the lateral and wide directions; 2. by the locking piece, the two parts are longitudinally limited, for a solid and stable structure; and 3. by convenient and easy installation, the locking piece can be installed to complete the installation after the snap part is connected to the opening.

Referring to FIGS. 1-8, a chair frame 100 according to the present disclosure is now described. The chair frame 100 illustratively uses a connection structure, which includes a chair frame body that includes a seat board 104, a backboard 102, and an armrest assembly 101*a*-101*b*. The armrest assembly 101*a*-101*b* is provided opposite to each other, with the seat board 104 and backboard 102 being provided between the armrest assembly 101*a*-101*b* by the connection structure, respectively.

The connection structure comprises a first part with at least one L-shaped connection piece 106. The L-shaped connection piece 106 includes a fixed end and a snap-on end, with the fixed end and the snap-on end having an angle of a between them. The snap-on end 106 is provided along the length of the first part's surface, and the closest distance between the snap-on end and the first surface is L1. The second part is provided with at least one opening 110, 111, and the snap-on part extends into the opening 110 and slides to the bottom of the opening to complete the snap. A locking piece 107 passes through the first part and fixedly connected to the second part or passing through the second part and fixedly connected to the first part. To enable the snap-on part to be snapped to the side wall of the second part, the second part is of hollow material, having a wall thickness of e, L1<=e.

To enable the snap-on part to reach into the opening 110, the distance between the center of the semicircle at both ends of the opening 110 is L2, and the length of the snap-on part is L3, L2>=L3. The diameter of the semicircle at both ends of the opening 110 is d1, and the thickness of the L-shaped connection piece 106 is d2, d1>=d2. Also, a is not less than 90° and not more than 100°, thus having a certain inclination to have a guiding effect.

For a more stable structure and a more solid connection, the first part is provided with a first through-hole, the second part is provided with a first connection hole, and the locking piece 107 passes through the first through-hole, and locks with the first connection hole; or, the second part is provided with a second through-hole, the first part is provided with a second connection hole, and the locking piece 107 passes through the second through-hole and locks with the second connection hole.

To enable the seat board 104, the backboard 102, and the armrest assembly 101*a*-101*b* to be interconnected to form a whole, the backboard and the seat board are provided as the first part, and the armrest assembly is provided as the second part. The seat board 104 is provided with several L-shaped connection pieces 106 to cooperate with numerous openings 110 correspondingly provided on the armrest assembly 101*a*-101*b*. The backboard 102 is provided with several L-shaped connection pieces 106 to cooperate with numerous openings 110 correspondingly provided on the armrest assembly 101*a*-101*b*. The locking piece 107 is fixedly connected to the armrest assembly 101*a*-101*b* through the backboard 102. The backboard 102 is provided at the rear of the seat board 104, and the backboard 102 provides lateral restriction. The locking piece 107 is set to provide longitudinal restriction for backboard 102. Similarly, the backboard 102 and seat board 104 can also be set as the second part and the armrest assembly 101*a*-101*b* as the first part for connection. Such a setup also falls within the scope of the present disclosure.

According to the above design, the L-shaped connection piece and the opening are connected so that the lateral and wide directions between the two parts are restricted. The longitudinal direction between the two parts is restricted by the locking piece, for a solid and stable structure. The operation is convenient and easy, and can be completed by installing the locking piece after the snap-on part is connected to the opening.

A connection structure, characterized by: the first part, with at least one L-shaped connecting piece set; the L-shaped connecting piece comprises a fixed end and a snap-on end, with the angle between the fixed end and the snap-on end being α; and the snap-on end is set along the length of the first part's surface, and the snap-on end has the closest distance of L1 from the first surface.

The second part has at least one opening set, and the snap-on part extends into the opening and slides to the opening bottom to achieve the snap-on. A locking piece passes through the first part and fixedly connects to the second part, or passes through the second part and then fixedly connects to the first part.

Referring again to FIGS. 1-8, a chair assembly 100 according to the present disclosure is now described. The chair assembly 100 comprises first and second arm rests 101*a*-101*b*, a backboard 102, a first pair of connection devices 103*a*-103*b* coupling the backboard between the first and second arm rests, a seat board 104, and a second pair of connection devices 105*a*-105*b* coupling the seat board between the first and second arm rests. Each connection device 103*a*-103*b*, 105*a*-105*b* comprises one or both of a first L-shaped anchor 106, and a second transverse anchor 107. Each connection device 103*a*-103*b*, 105*a*-105*b* comprises one or both of first and second openings 110, 111 opposite to and receiving the first L-shaped anchor 106 and the second transverse anchor 107 for coupling.

Each of the first and second arm rests 101*a*-101*b*, the seat board 104, and the backboard 102 may comprise a hollow structure. Also, each of the first and second arm rests 101*a*-101*b*, the seat board 104, and the backboard 102 may comprise a rigid material, such as aluminum.

In some embodiments, the second transverse anchor 107 may comprise a snap fastener. Also, for the component carrying the second transverse anchor 107, the component may comprise a through-hole 112 for receiving the second transverse anchor 107 and being aligned with the second opening 111. The first opening 110 may comprise an elongate opening, and the second opening 111 may comprise a circle-shaped opening.

In the illustrated embodiment, only two connection devices 103*a*-103*b* comprise both the first L-shaped anchor 106 and the second transverse anchor 107, and both the first and second openings 110, 111 for coupling (i.e., the lower connection devices coupling the backboard 102 and the first and second arm rests 101*a*-101*b*). The other connection devices 105*a*-105*b* comprise only the first L-shaped anchor 106 and the first opening 110. Of course, in other embodiments, the other connection devices 105*a*-105*b* may also comprise both anchors and openings.

One aspect is directed to a method for making a chair assembly 100 to be assembled by a user. The method comprises providing first and second arm rests 101*a*-101*b*, providing a backboard 102, and forming a first pair of connection devices 103*a*-103*b* for coupling the backboard between the first and second arm rests. The method also includes providing a seat board 104, and forming a second pair of connection devices 105*a*-105*b* for coupling the seat board between the first and second arm rests 101*a*-101*b*. Each connection device 103*a*-103*b*, 105*a*-105*b* comprises a first L-shaped anchor 106, and a second transverse anchor 107, and first and second openings 110, 111 opposite to and receiving the first L-shaped anchor and the second transverse anchor for coupling.

In the illustrated embodiment, the backboard and the seat board both carry the first L-shaped anchor 106 and the second transverse anchor 107 for each of the connection devices 103*a*-103*b*, 105*a*-105*b*, and the first and second arm rests 101*a*-101*b* carry the first and second openings 110, 111. Of course, in other embodiments, the position of the anchors and the openings may be reversed. Further, it should be appreciated that the connection devices 103*a*-103*b*, 105*a*-105*b* may be applied to other furniture items for quick assembly, such as tables, lounge chairs, couches, etc.

For assembly of the chair assembly 100, the seat board 104 is coupled to the first and second arm rests 101*a*-101*b* via the first L-shaped anchors 106 extending from the sides of the seat board, and the first openings 110 on the first and second arm rests. Then, the backboard 102 is coupled to the first and second arm rests 101*a*-101*b* via the L-shaped anchors 106 extending from the sides of the backboard. Once the backboard 102 is locked into position, the second transverse anchors 107 are positioned through the through-holes in the backboard and into the second openings 111 on the first and second arm rests 101*a*-101*b*. As perhaps best seen in FIG. 2, the backboard 102 abuts and retains the seat board 104 from sliding out of locked position.

Referring now to FIGS. 9-15, another embodiment of the chair assembly 200 is now described. The chair assembly 200 illustratively includes first and second arm rests 201*a*-201*b*, a backboard 202, and a pair of first connection devices 203*a*-203*b* coupling the backboard between the first and second arm rests. The chair assembly 200 includes a seat board 204, and a pair of second connection devices 205*a*-205*b* coupling the seat board between the first and second arm rests 201*a*-201*b*.

Figure 13:
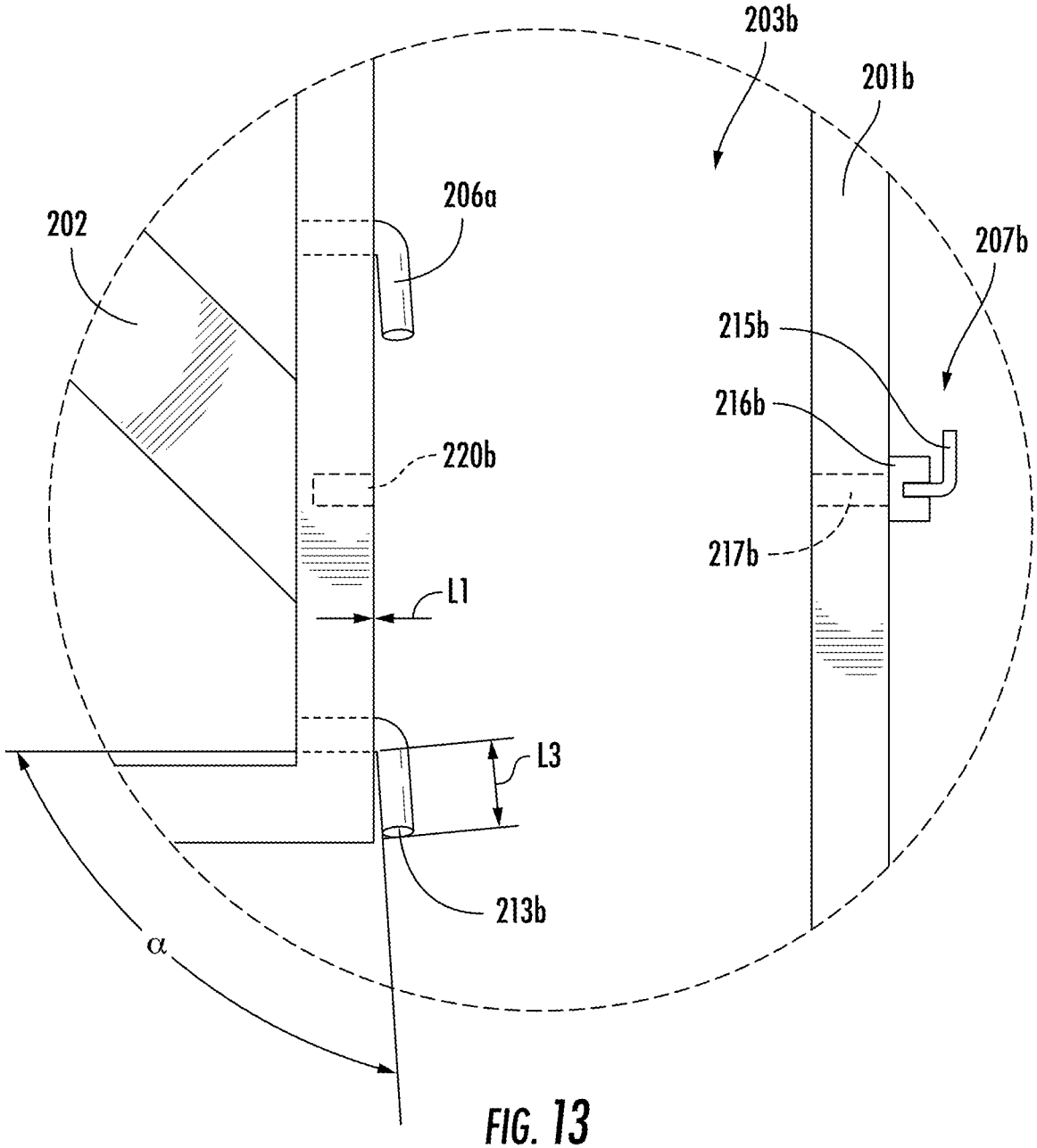
FIG. 13 is an enlarged top plan view of the backboard and a second arm rest of FIG. 9 in spaced apart relation.
Figure 14:
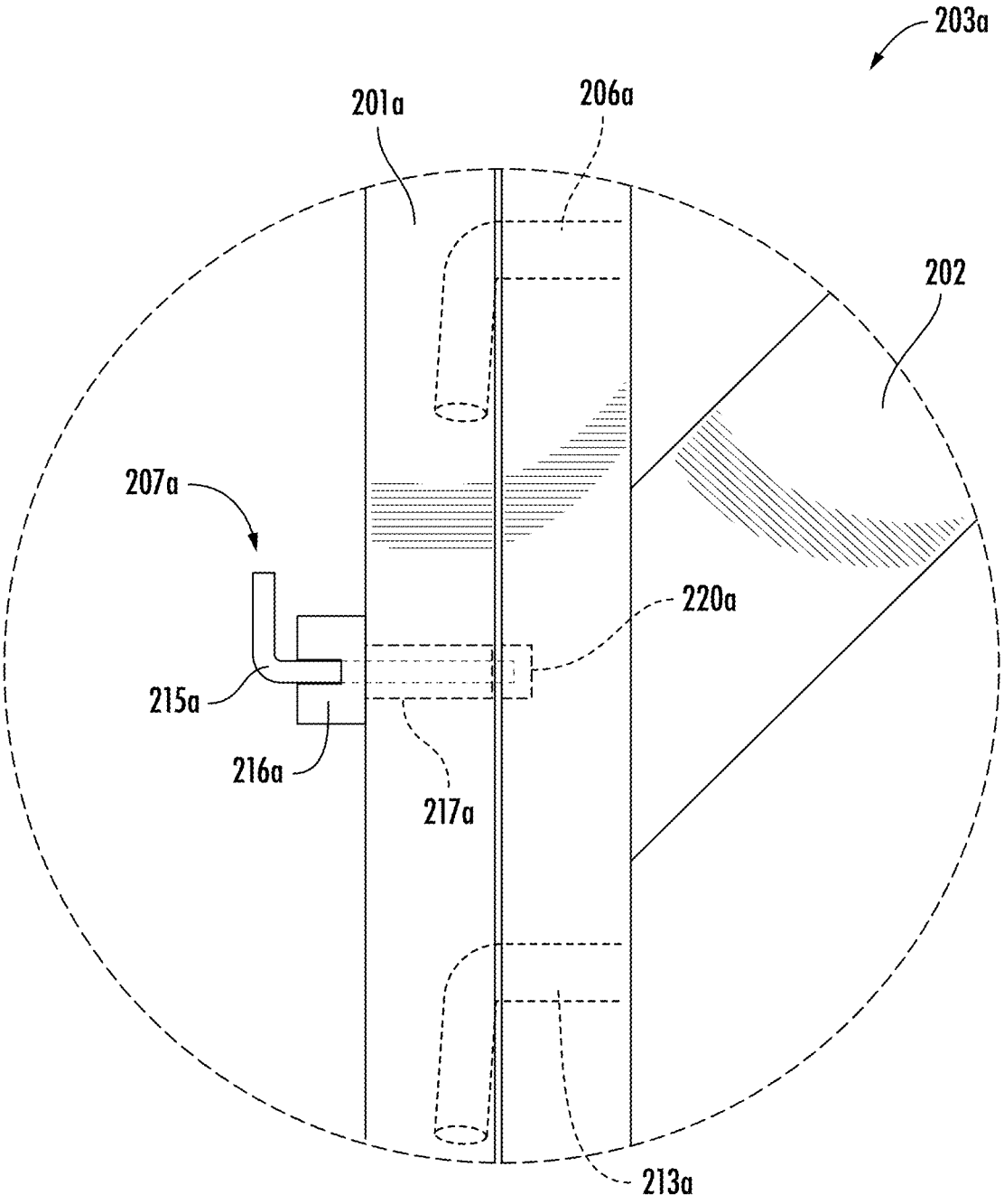
FIG. 14 is an enlarged top plan view of the backboard and a first arm rest of FIG. 9 coupled together.
Figure 15:
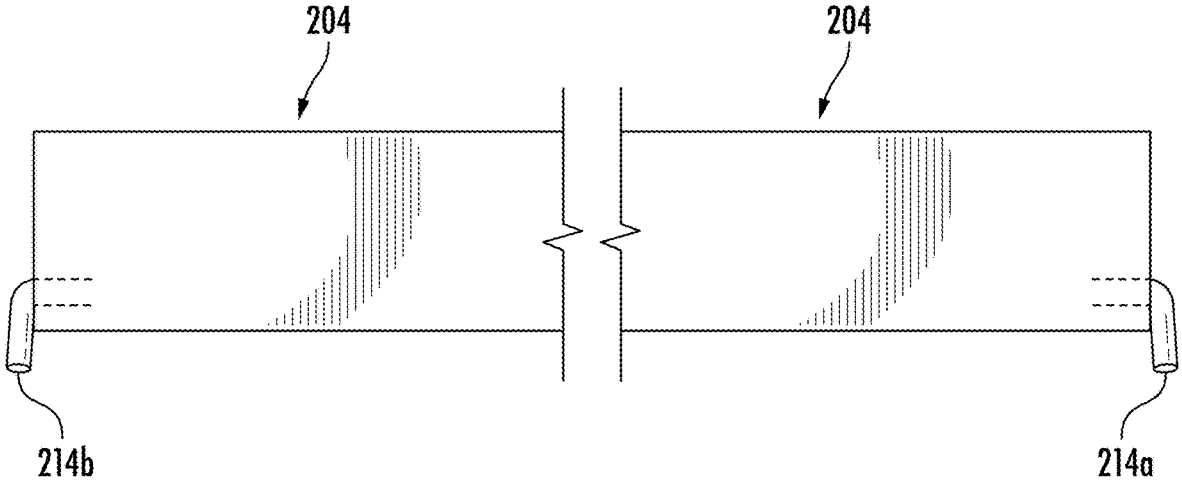
FIG. 15 is a rear plan view of the seat board of from the chair assembly of FIG. 9.
Figure 16:
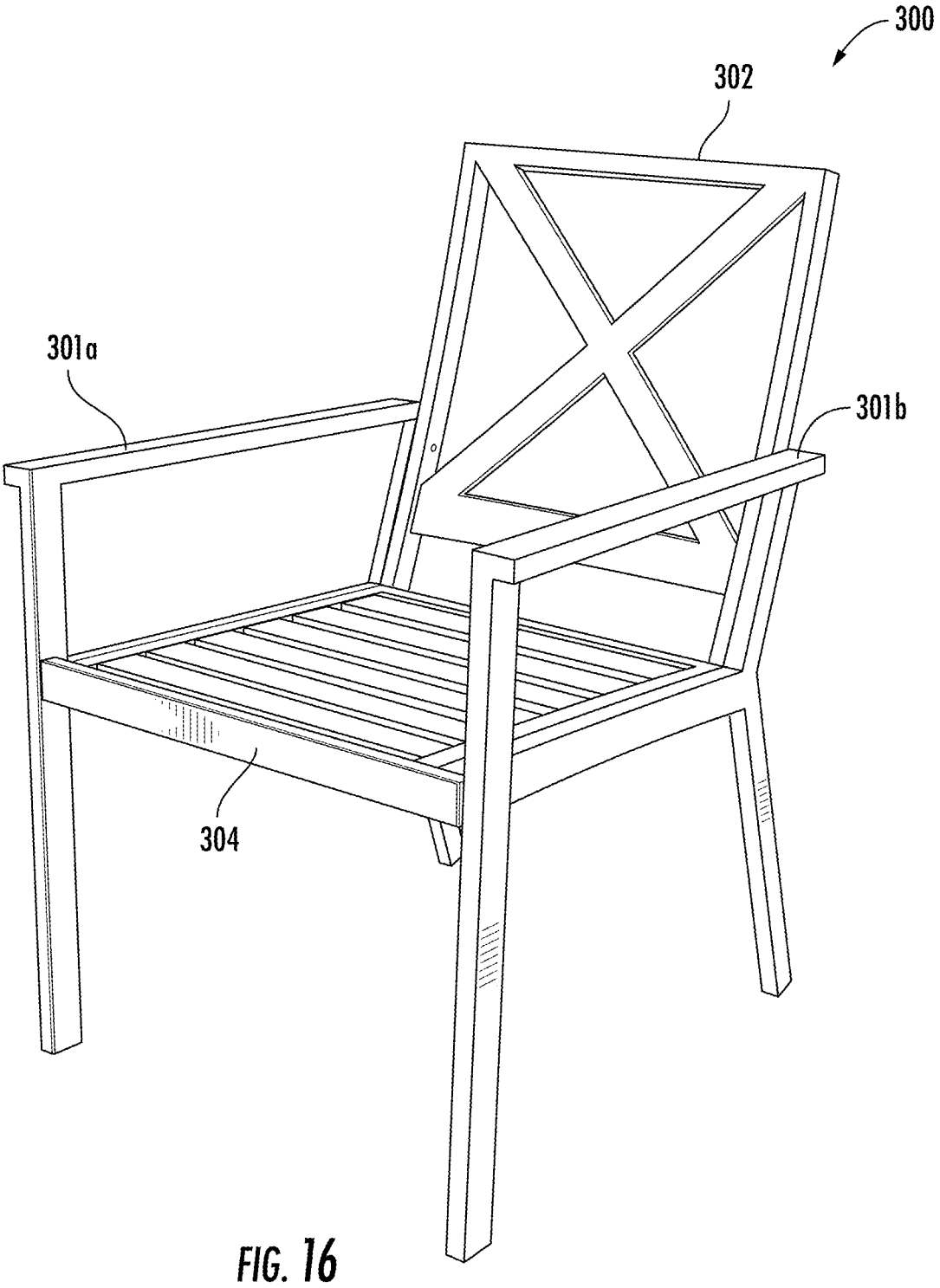
FIG. 16 is a perspective view of a third example embodiment of a chair assembly, according to the present disclosure.
Figure 17:
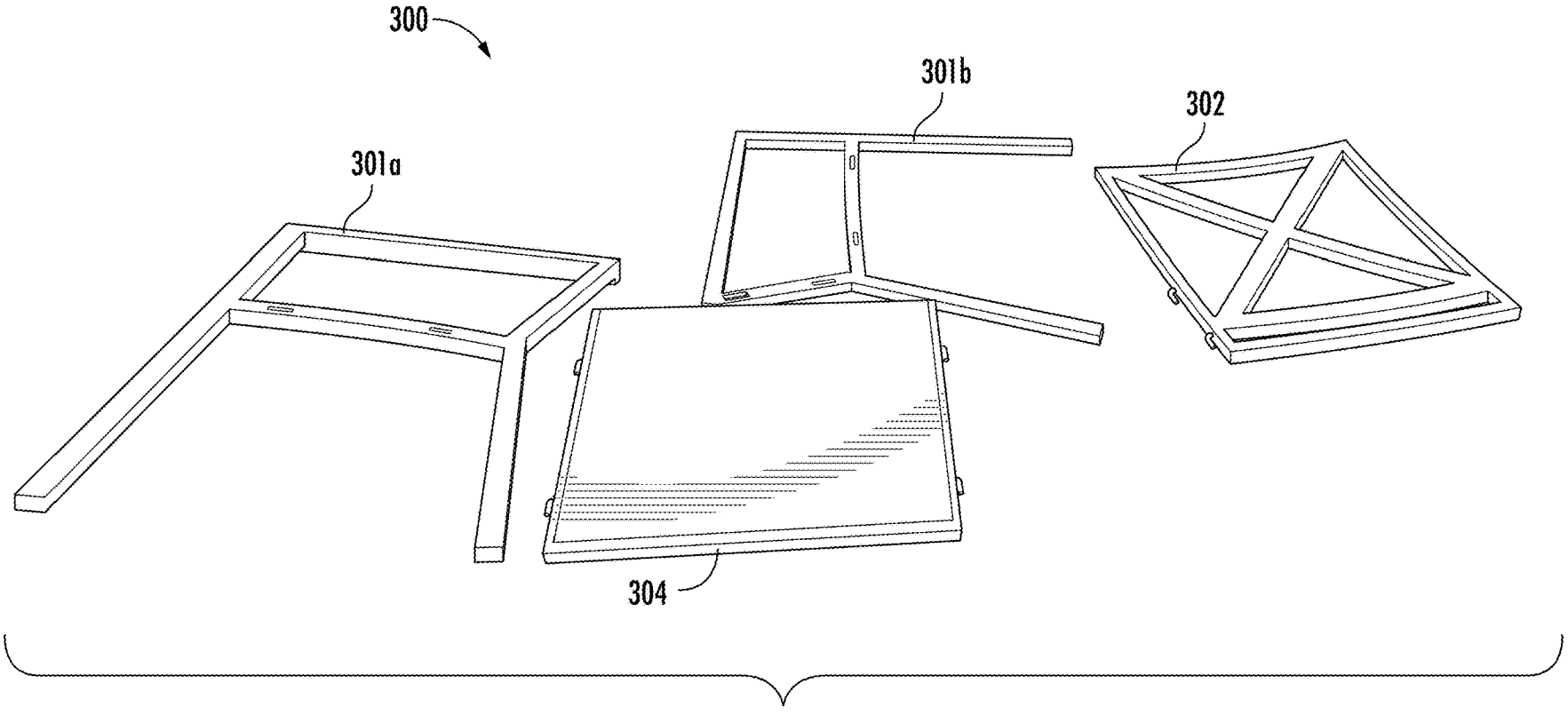
FIG. 17 is an exploded view of the chair assembly of FIG. 16.
Figure 18:
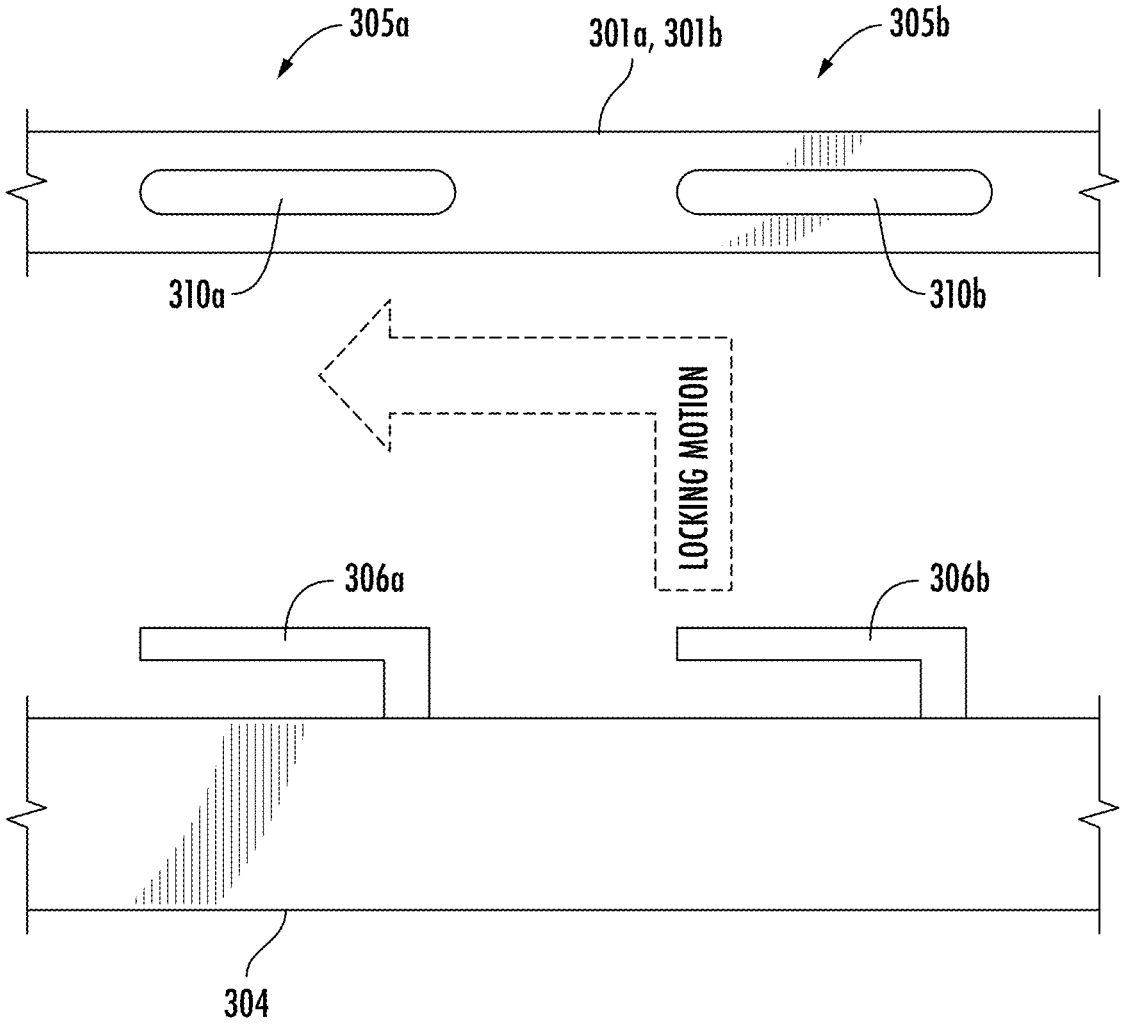
FIGS. 18-19 are partial views of adjacent components from the chair assembly of FIG. 16.
Figure 19:
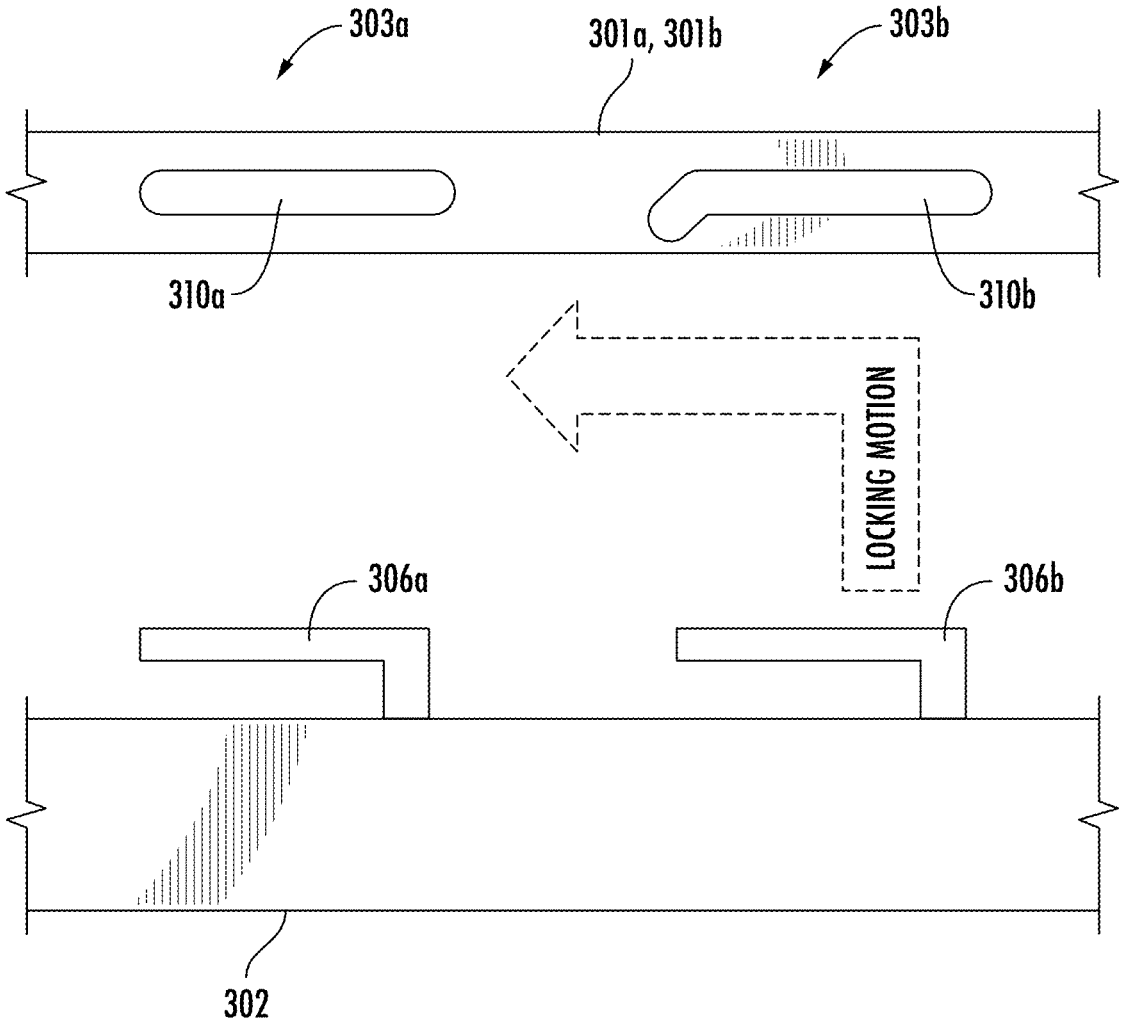

As perhaps best seen in FIGS. 13-14, each first connection device 203*a*-203*b* illustratively comprises a first L-shaped anchor 206*a*-206*b*, a second transverse anchor 207*a*-207*b* spaced apart from the first L-shaped anchor, and a third L-shaped anchor 213*a*-213*b* spaced apart from the second transverse anchor (i.e., the second transverse anchor being between the first and third L-shaped anchors). Each first connection device 203*a*-203*b* also comprises first, second, and third openings opposite to and receiving the first L-shaped anchor 206*a*-206*b*, the second transverse anchor 207*a*-207*b*, and the third L-shaped anchor 213*a*-213*b* for coupling.

As perhaps best seen in FIG. 13, the first L-shaped anchor 206*a*-206*b* is illustratively canted at an angle α with respect to the first and second arm rests 201*a*-201*b* and the backboard 202. The third L-shaped anchor 213*a*-213*b* may also be canted at the angle α with respect to the first and second arm rests 201*a*-201*b* and the backboard 202 For example, the angle α may be less than 15°. As will be appreciated, the canting at the angle α may allow for easy guidance of the first L-shaped anchor 206*a*-206*b* and the third L-shaped anchor 213*a*-213*b* respectively into the first and third openings during assembly.

Each second connection device 205*a*-205*b* illustratively includes a fourth L-shaped anchor 214*a*-214*b*, and a fourth opening opposite to and receiving the fourth L-shaped anchor for coupling. Here, the fourth L-shaped anchor 214*a*-214*b* illustratively extends downward, and the fourth openings respectively in the first and second arm rests 201*a*-201*b* would similarly be elongated along a vertical longitudinal axis. Advantageously, the fourth L-shaped anchors 214*a*-214*b* extend in the same direction as the shear force imparted onto the seat board 204 when the chair assembly 200 is in use.

Similar to the first L-shaped anchor 206*a*-206*b* and the third L-shaped anchor 213*a*-213*b*, the fourth L-shaped anchor 214*a*-214*b* is illustratively canted at the angle α with respect to the first and second arm rests 201*a*-201*b* and the seat board 204. Further, each of the first and second arm rests 201*a*-201*b* illustratively comprises a protrusion 208*a*-208*b*, which receives by the seat board 204 (i.e., the protrusion serves as a ledge for the seat board and resists against the shear forces whole the chair assembly 200 is in use).

In some embodiments, the second transverse anchor 207*a*-207*b* may comprise a snap fastener (FIGS. 1-8). In yet other embodiments, the second transverse anchor 207*a*-207*b* may comprise another L-shaped anchor (FIGS. 16-19). In this illustrated embodiment, the second transverse anchor 207*a*-207*b* includes an elongate anchor 215*a*-215*b* extending through the first and second arm rests 201*a*-201*b* and the backboard 202 (on both sides). Here, the elongate anchor 215*a*-215*b* is L-shaped, which provides a user with an easier hand grip. The second transverse anchor 207*a*-207*b* illustratively comprises a housing 216*a*-216*b* coupled to the first and second arm rests 201*a*-201*b* and receiving the elongate anchor 207*a*-207*b*. The housing 216*a*-216*b* is positioned over the second opening. The housing 216*a*-216*b* may define a slotted recess to receive adjacent portions of the elongate anchor 215*a*-215*b* and to retain it therein.

Further, as shown in FIGS. 13-14, the first and second arm rests 201*a*-201*b* each illustratively comprises a passageway 217*a*-217*b* for receiving the second transverse anchor 207*a*-207*b*. The backboard 202 also illustratively includes a blind passageway 220*a*-220*b* for receiving distal ends of the second transverse anchors 207*a*-207*b*.

In some embodiments, the first and second arm rests 201*a*-201*b*, the backboard 202, and the seat board 204 may be hollow. In other embodiments, the first and second arm rests 201*a*-201*b*, the backboard 202, and the seat board 204 may be solid with respective recesses for the first, second, third, and fourth openings. As for material, the first and second arm rests 201*a*-201*b*, the backboard 202, and the seat board 204 may comprise any rigid material with sufficient mechanical strength, for example, metallic materials such as aluminum, or polymers, such as plastic polymers.

Figure 4:
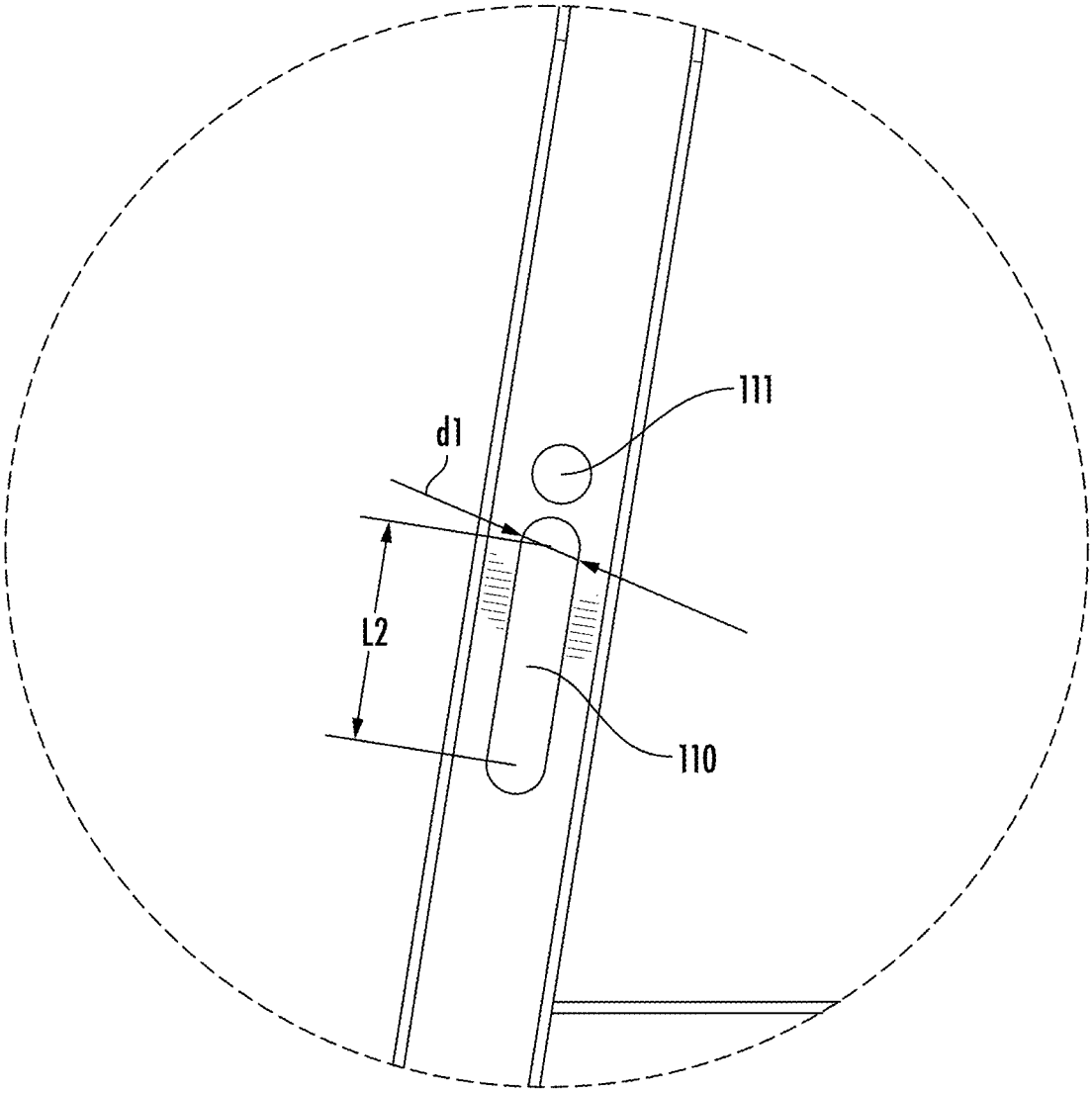
FIG. 4 is an enlarged side view of the arm rest of FIG. 3 at section A-A.
Figure 5:
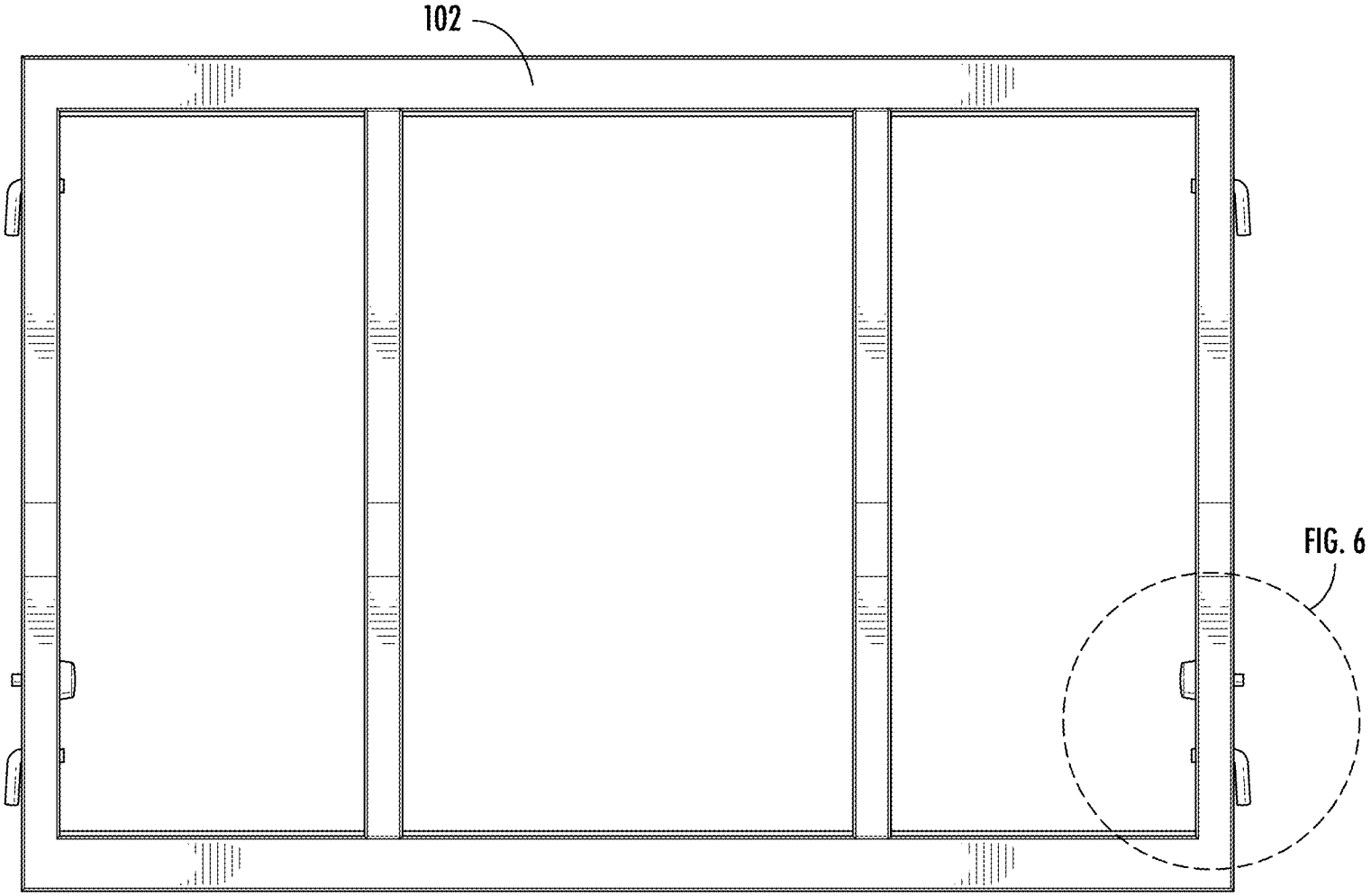
FIG. 5 is a top plan view of a backboard from the chair assembly of FIG. 1.
Figure 6:
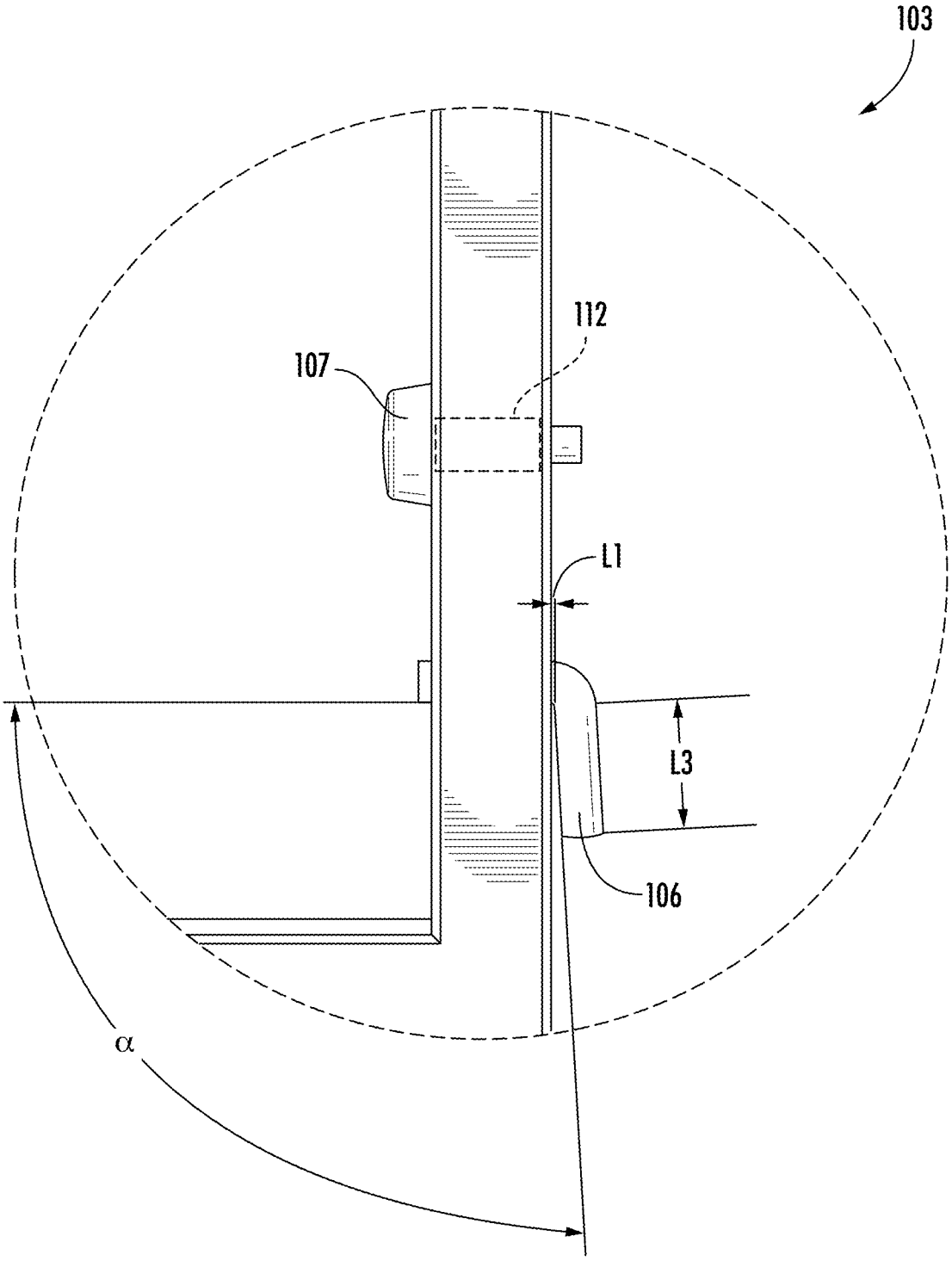
FIG. 6 is an enlarged top plan view of the backboard of FIG. 5 at section B-B.
Figure 7:
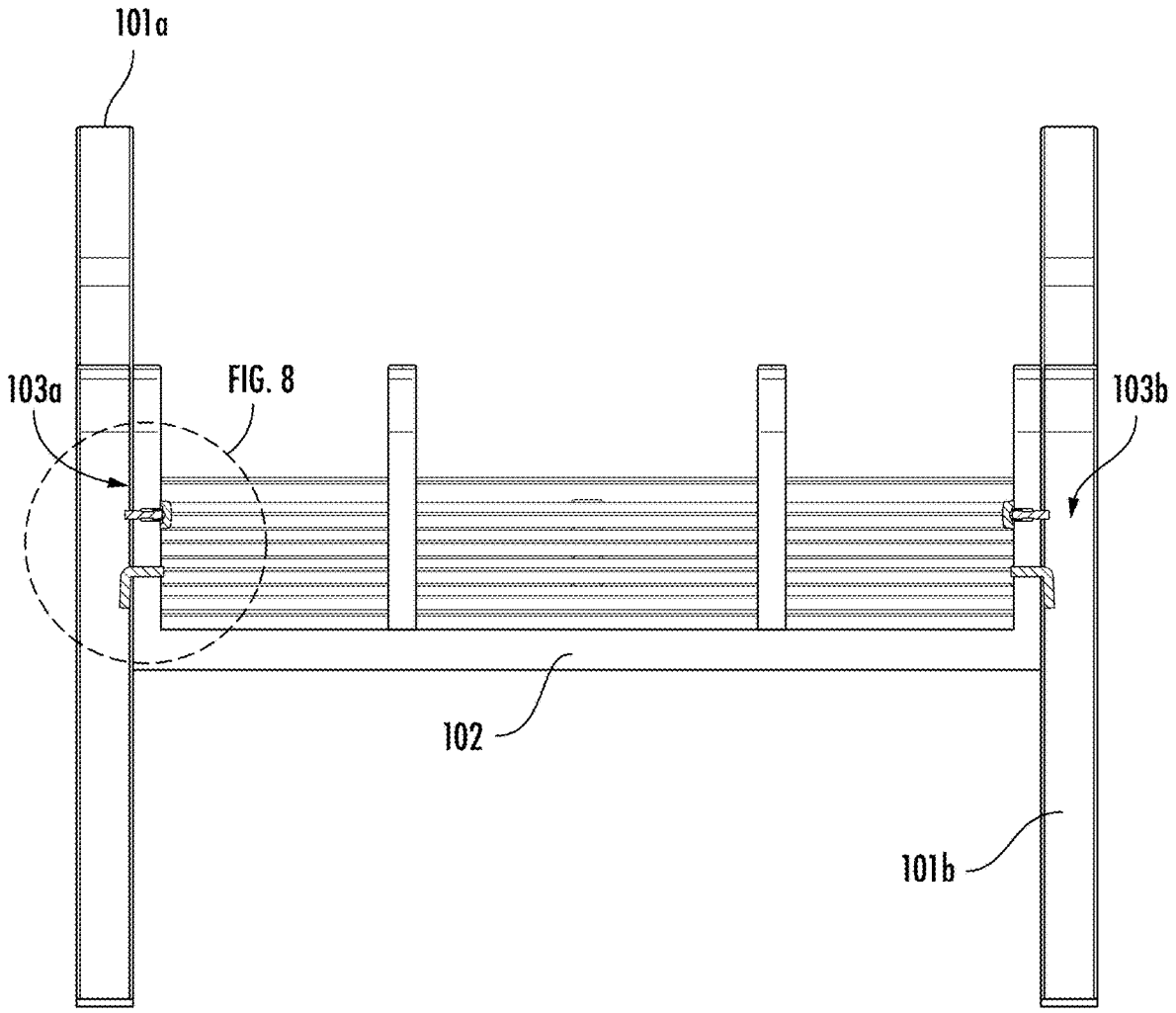
FIG. 7 is a rear view of the chair assembly of FIG. 1.
Figure 8:
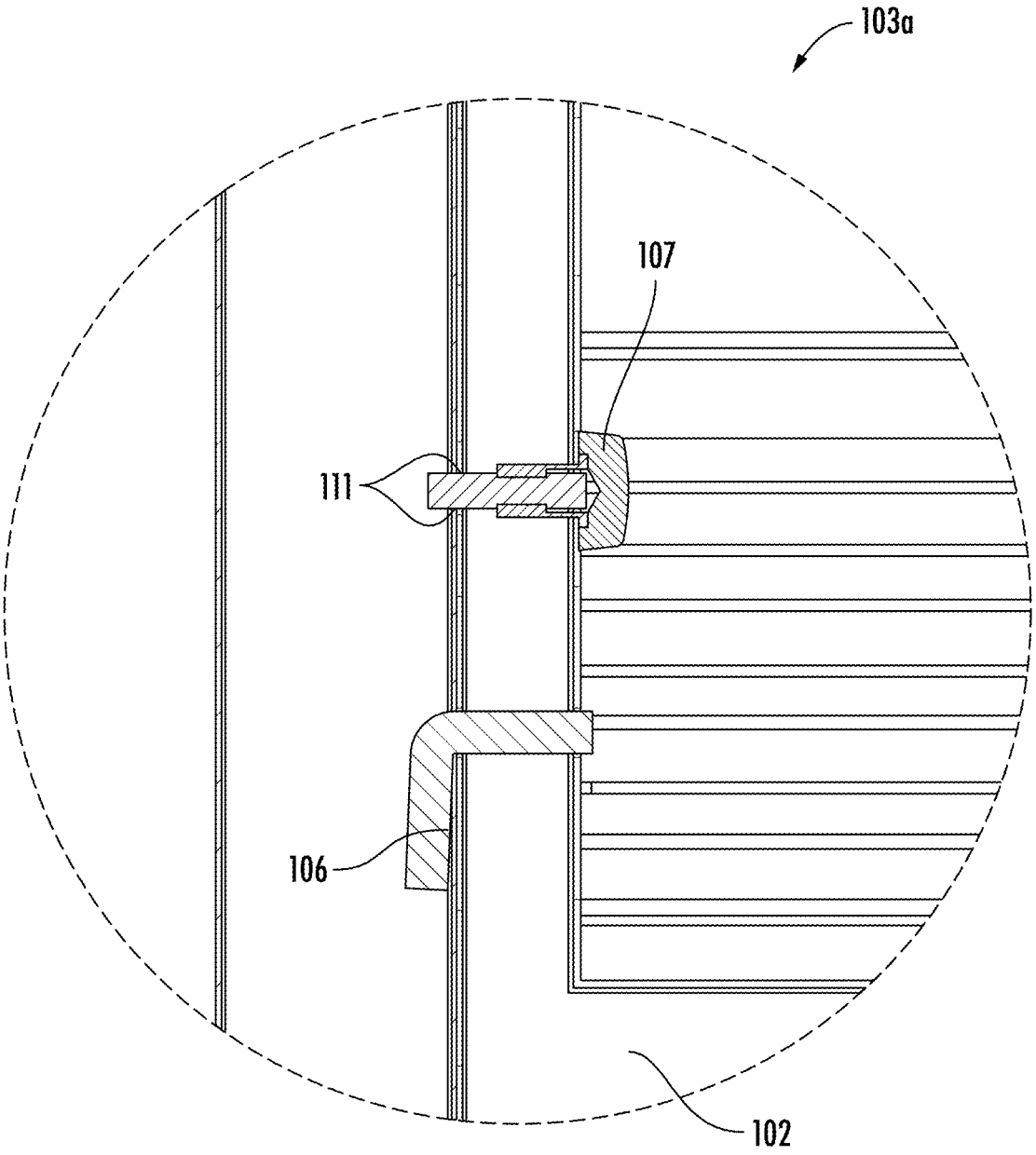
FIG. 8 is an enlarged rear view of the chair assembly of FIG. 7 at section C-C.
Figure 9:
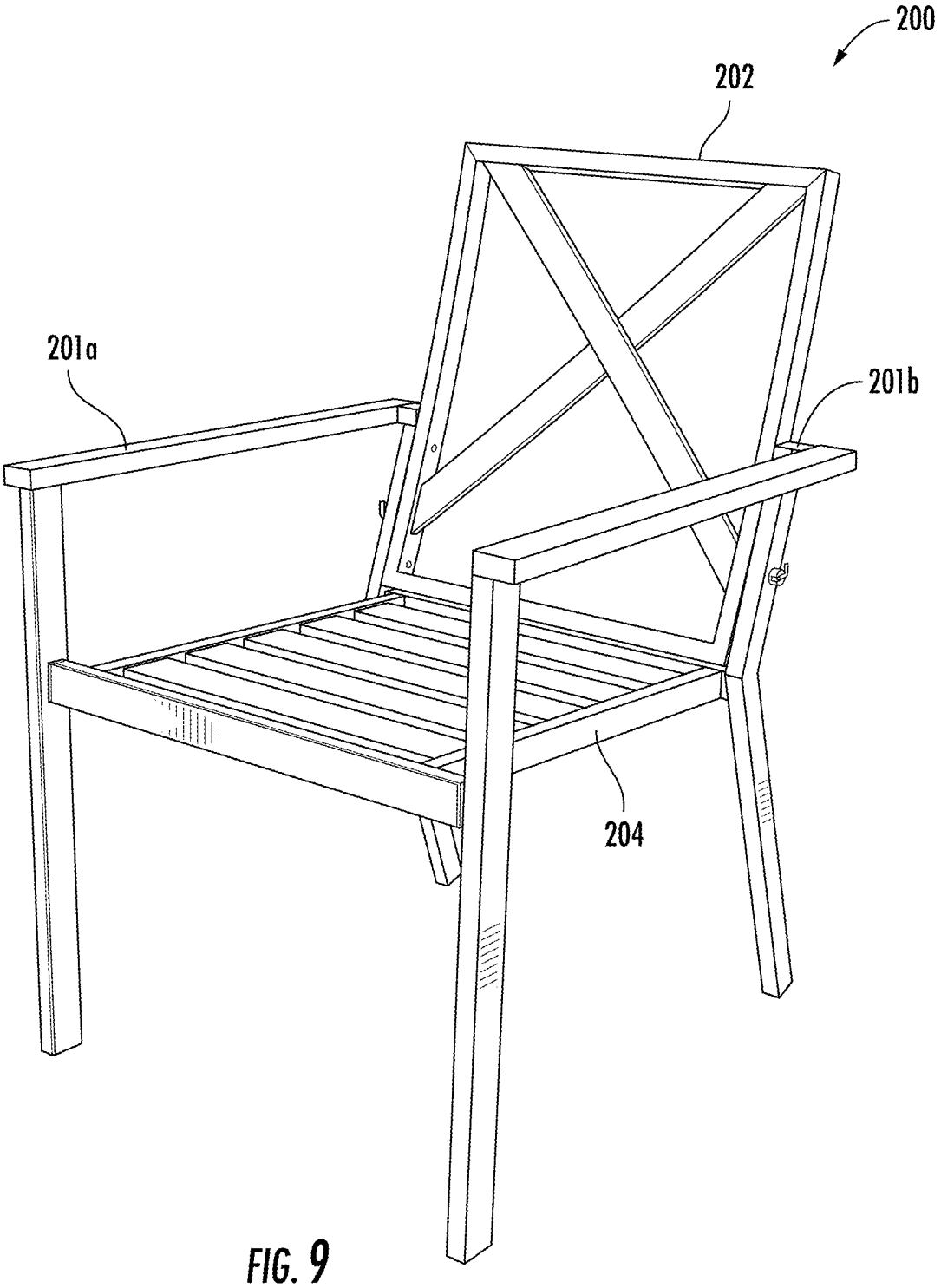
FIG. 9 is a perspective view of a second example embodiment of a chair assembly, according to the present disclosure.
Figure 10:
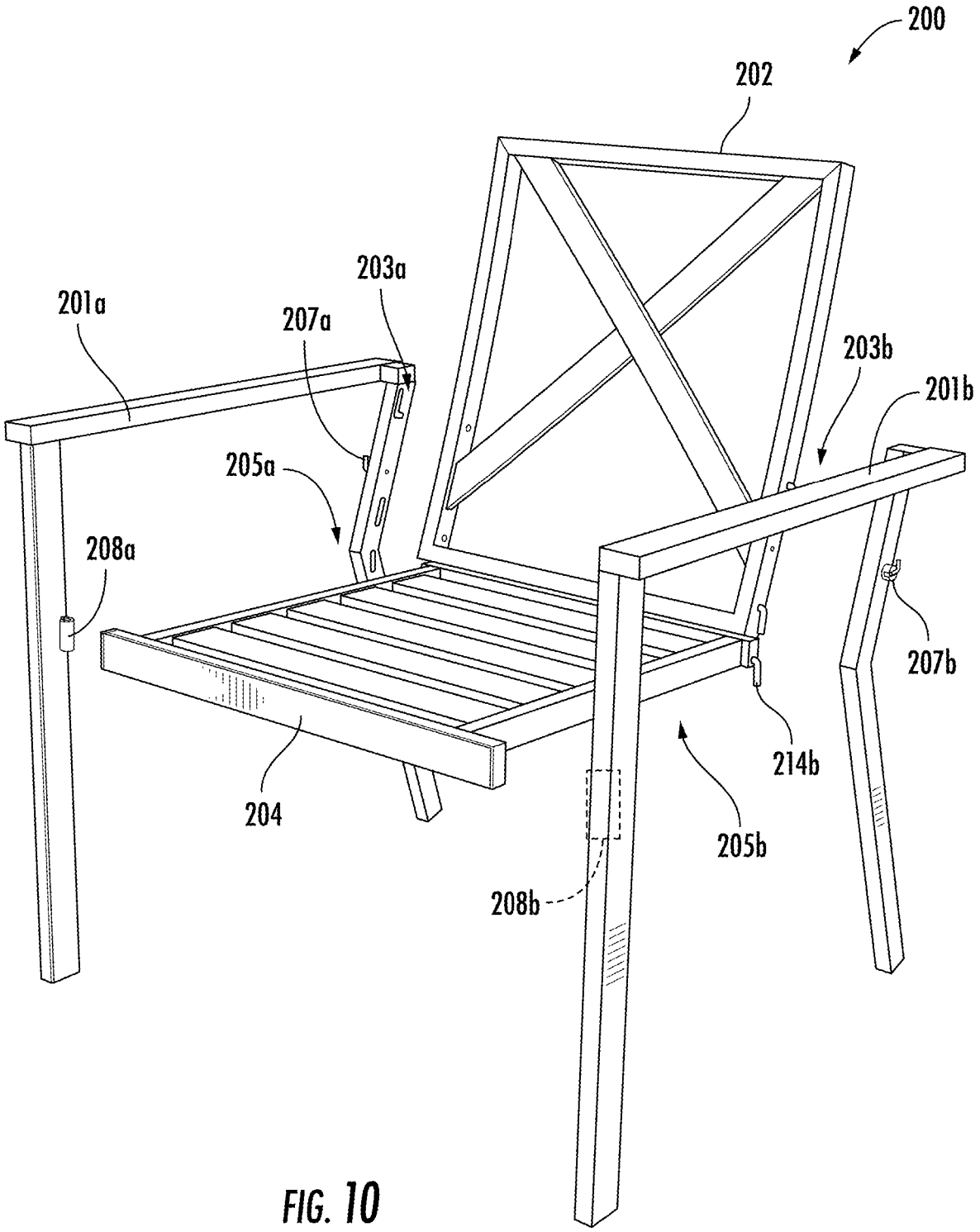
FIG. 10 is a partially exploded view of the chair assembly of FIG. 9.
Figure 11:
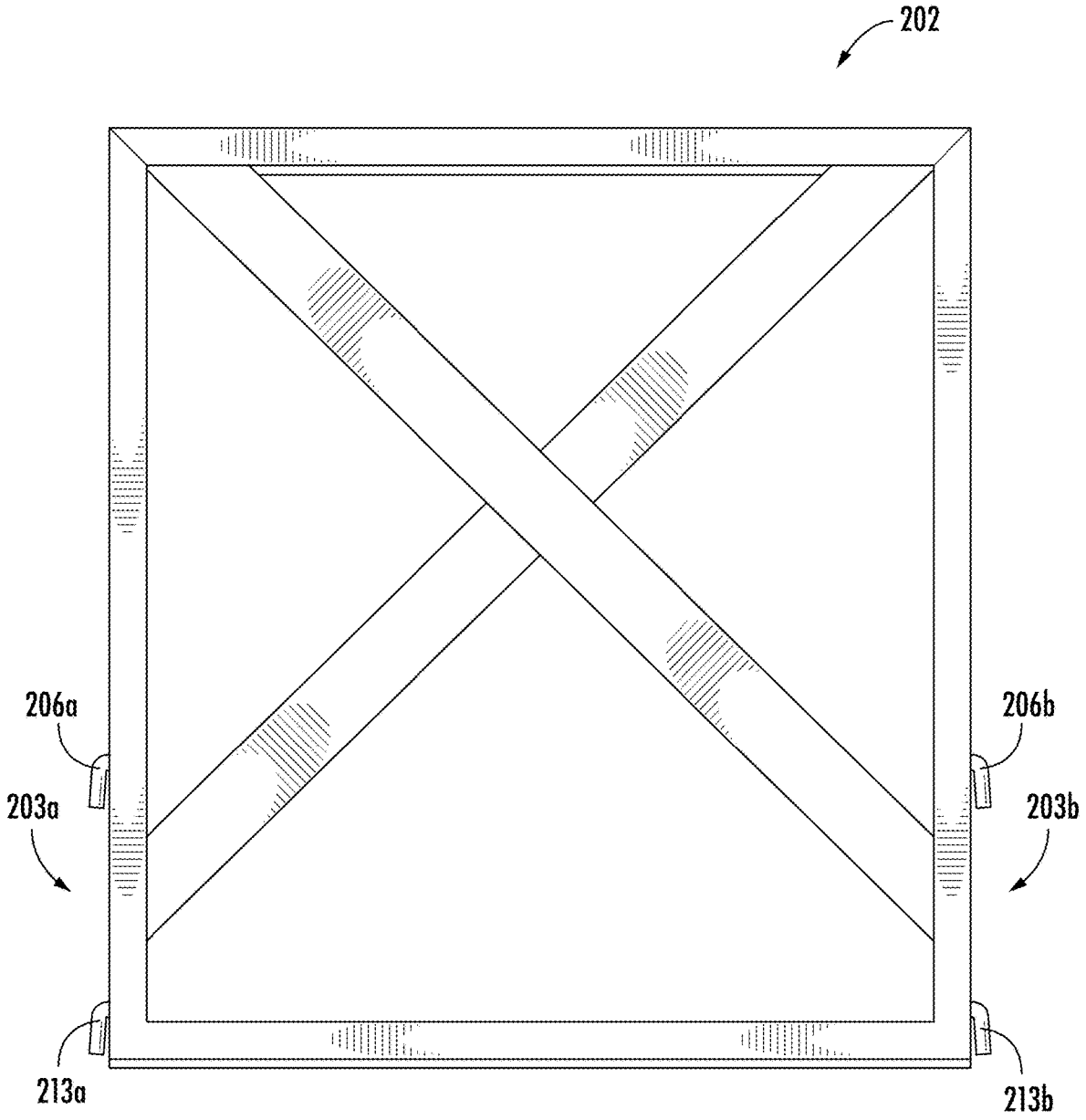
FIG. 11 is a top plan view of a backboard from the chair assembly of FIG. 9.
Figure 12:
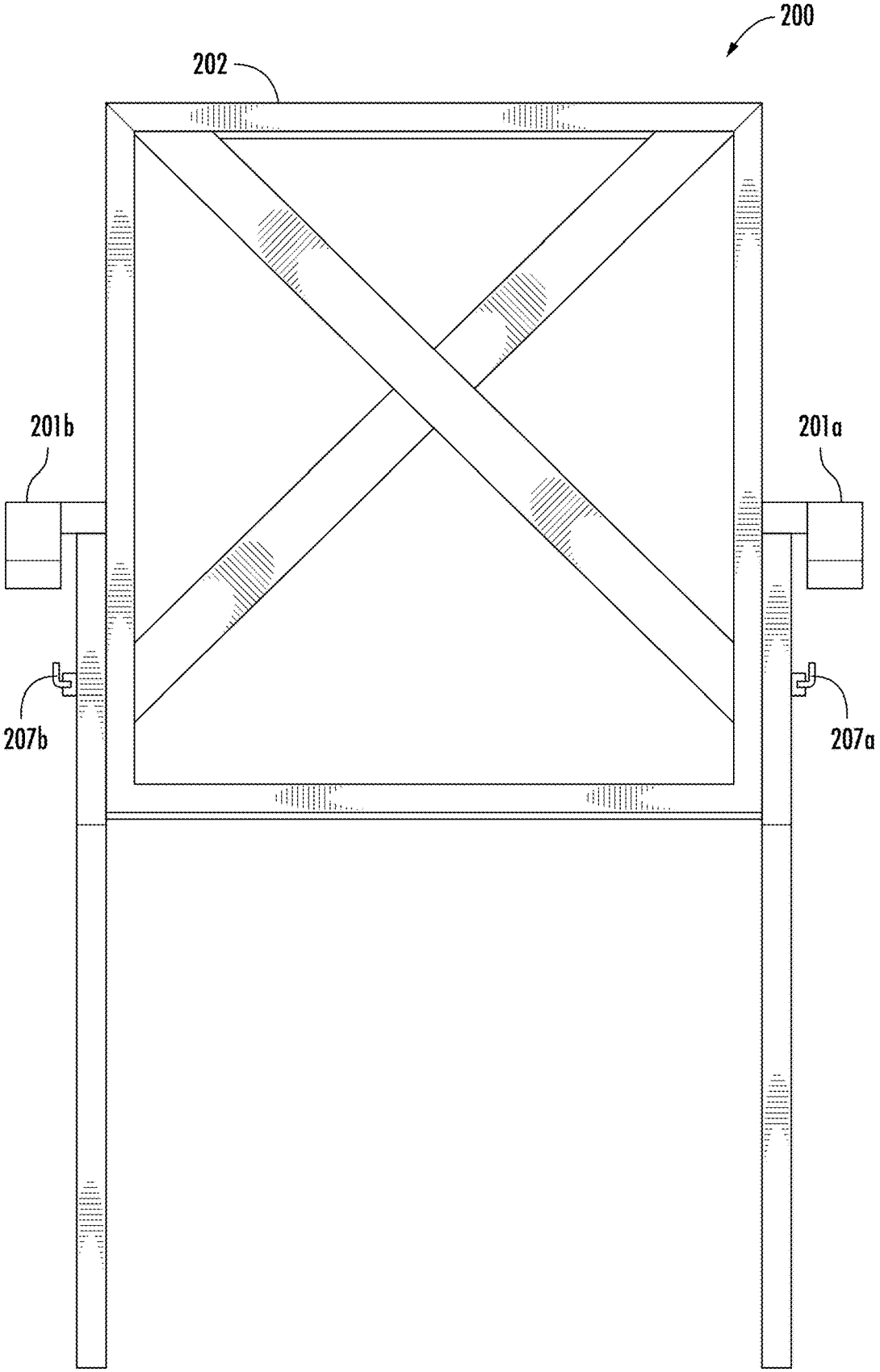
FIG. 12 is a rear plan view of the chair assembly of FIG. 9.

Also, the first opening, the third opening, and the fourth opening each comprises an elongate opening, which is similarly constituted to the first opening 110 of FIG. 4. The second opening comprises a circle-shaped opening, which is similarly constituted to the second opening 111 of FIG. 4.

In the illustrated embodiments, the first opening, the third opening, and the fourth opening are defined in each of the first and second arm rests 201*a*-201*b*. The first L-shaped anchor 206*a*-206*b*, the third L-shaped anchor 213*a*-213*b*, and the fourth L-shaped anchor 214*a*-214*b* are carried by the backboard 202 and seat board 204, and are respectively received within the first opening, the third opening, and the fourth opening. The second opening is defined within the backboard 202, and the second transverse anchor 207*a*-207*b* is received within the second opening. It should be appreciated that the placement of opening/anchor can be reversed, and is within the scope of the disclosed embodiments.

Another aspect is directed to a method for making a chair assembly 200 to be assembled by a user. The method comprises providing first and second arm rests 201*a*-201*b* and a backboard 202, forming a pair of first connection devices 203*a*-203*b* to be coupled between the backboard and the first and second arm rests, and providing a seat board 204. The method also includes forming a pair of second connection devices 205*a*-205*b* to be coupled between the seat board 204 and the first and second arm rests 201*a*-201*b*. Each first connection device 203*a*-203*b* comprises a first L-shaped anchor 206*a*-206*b*, and a second transverse anchor 207*a*-207*b*, and first and second openings opposite to and receiving the first L-shaped anchor and the second transverse anchor for coupling. Each second connection device 205-205*b* comprises a fourth L-shaped anchor 214*a*-214*b*, and a fourth opening opposite to and receiving the fourth L-shaped anchor for coupling.

During assembly, the user would first assemble the seat board 204 and the first and second arm rests 201*a*-201*b* by aligning the fourth L-shaped anchor 214*a*-214*b* into the fourth openings. The user would then position the backboard 202 between the first and second arm rests 201*a*-201*b*, aligning the first L-shaped anchor 206*a*-206*b* and the third L-shaped anchor 213*a*-213*b* with the first and third openings respectively. Lastly, the user would insert the second transverse anchor 207*a*-207*b* to lock the assembly into place for use.

Advantageously, the chair assembly 100, 200 may be readily assembled without any tools (i.e., toolless assembly). Further, as noted herein above, the first L-shaped anchor 206*a*-206*b*, the third L-shaped anchor 213*a*-213*b*, and the fourth L-shaped anchor 214*a*-214*b* are vertically oriented and aligned with the shear forces imparted on the chair assembly 100, 200 during use. This may provide for a more durable chair assembly 100, 200. Further, the pair of first connection devices 203*a*-203*b* and the pair of second connection devices 205*a*-205*b* may be disassembled without degrading the physical integrity of the coupling.

Referring now additionally to FIGS. 16-19, another embodiment of the chair assembly 300 is now described. In this embodiment of the chair assembly 300, those elements already discussed above with respect to FIGS. 1-8 are incremented by 200 and most require no further discussion herein. This embodiment differs from the previous embodiment in that this chair assembly 300 illustratively includes first and second connection devices 305*a*-305*b*. Each of the first and second connection devices 305*a*-305*b* comprises first and second L-shaped connection pieces 306*a*-306*b* coupling the seat board 304 to each of the first and second arm rests 301*a*-301*b*. Each of the first and second arm rests 301*a*-301*b* has first and second openings 310*a*-310*b* to receive the first and second L-shaped connection pieces 306*a*-306*b*.

The chair assembly 300 illustratively includes third and fourth connection devices 303*a*-303*b*, each comprising first and second L-shaped connection pieces 306*a*-306*b* coupling the backboard 302 to each of the first and second arm rests 301*a*-301*b*. Each of the first and second arm rests 301*a*-301*b* has first and second openings 310*a*-310*b* to receive the first and second L-shaped connection pieces 306*a*-306*b*. Here, the second opening 310*b* comprises a canted shape, rather than the elongate straight shape of the first opening 310*a*. When the backboard 302 is coupled to the first and second arm rests 301*a*-301*b*, the backboard may be tilted to force the second L-shaped connection piece 306*b* into the canted terminal portion of the second opening 310*b*, thereby preventing unintended dislodgment.

Figure 20:
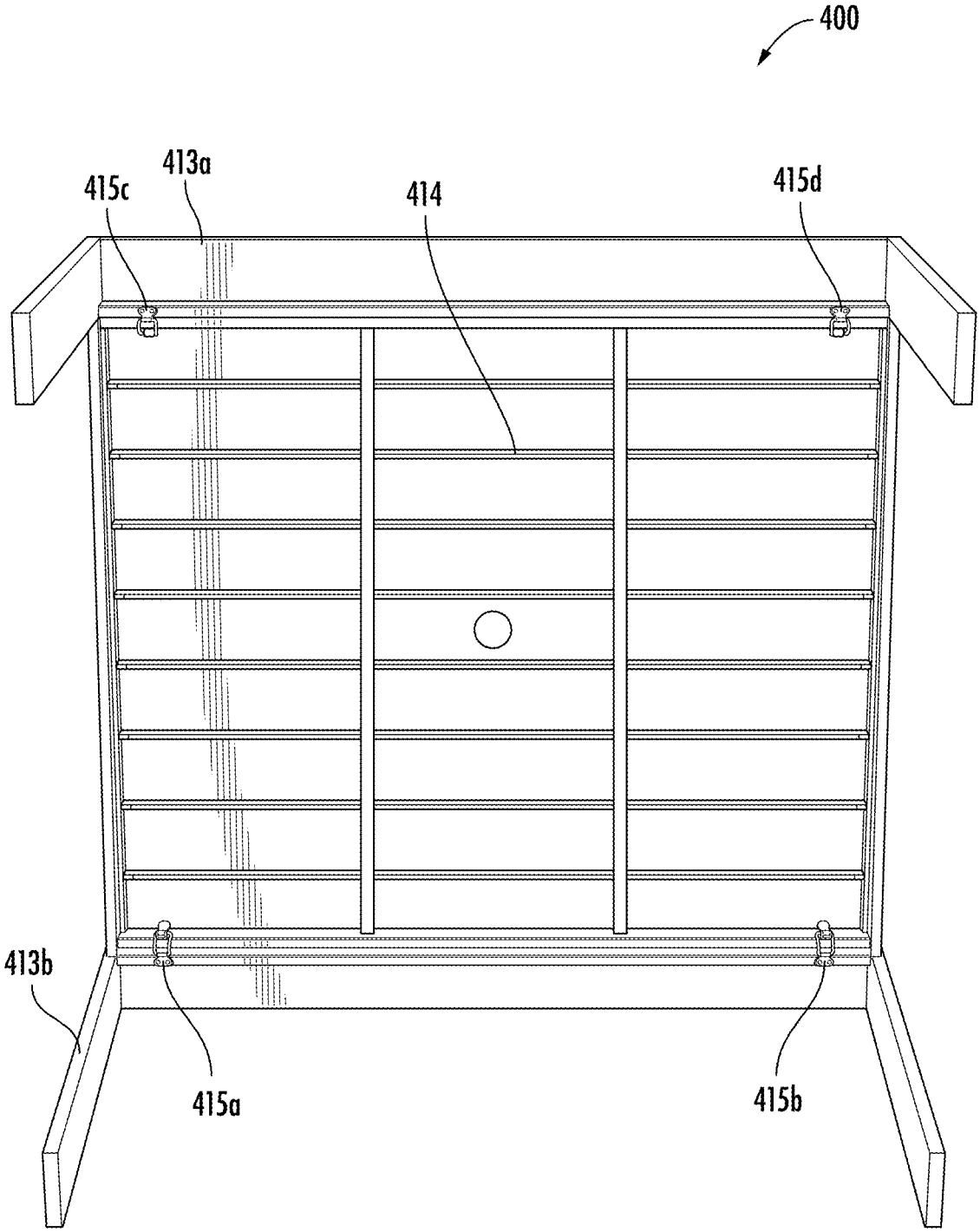
FIG. 20 is a perspective view of a first example embodiment of a table assembly, according to the present disclosure.
Figure 21A:
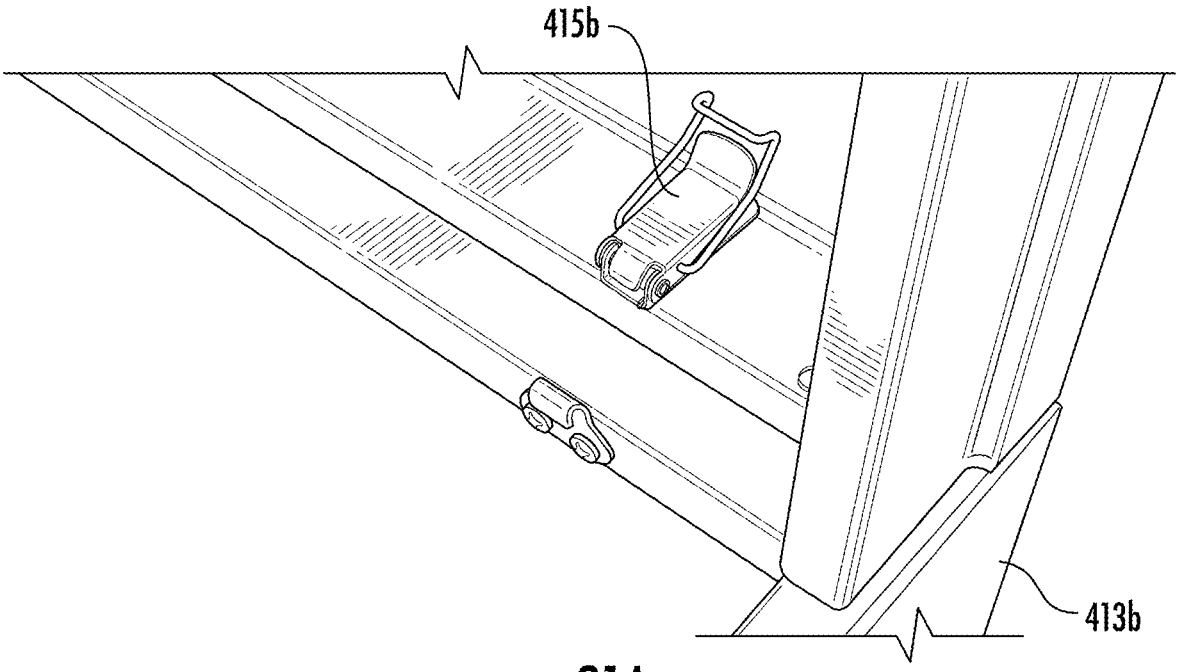
FIGS. 21A-21B are enlarged perspective views of the table assembly from FIG. 20 with the fastener in open and closed states, respectively.
Figure 21B:
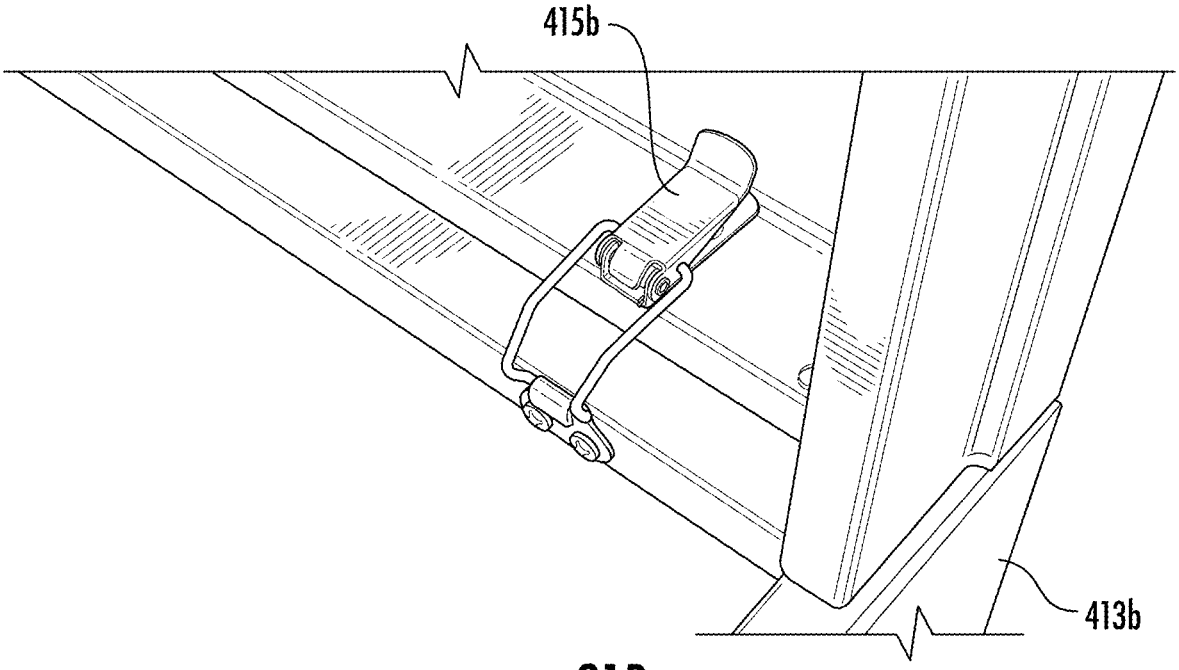
Figure 22:
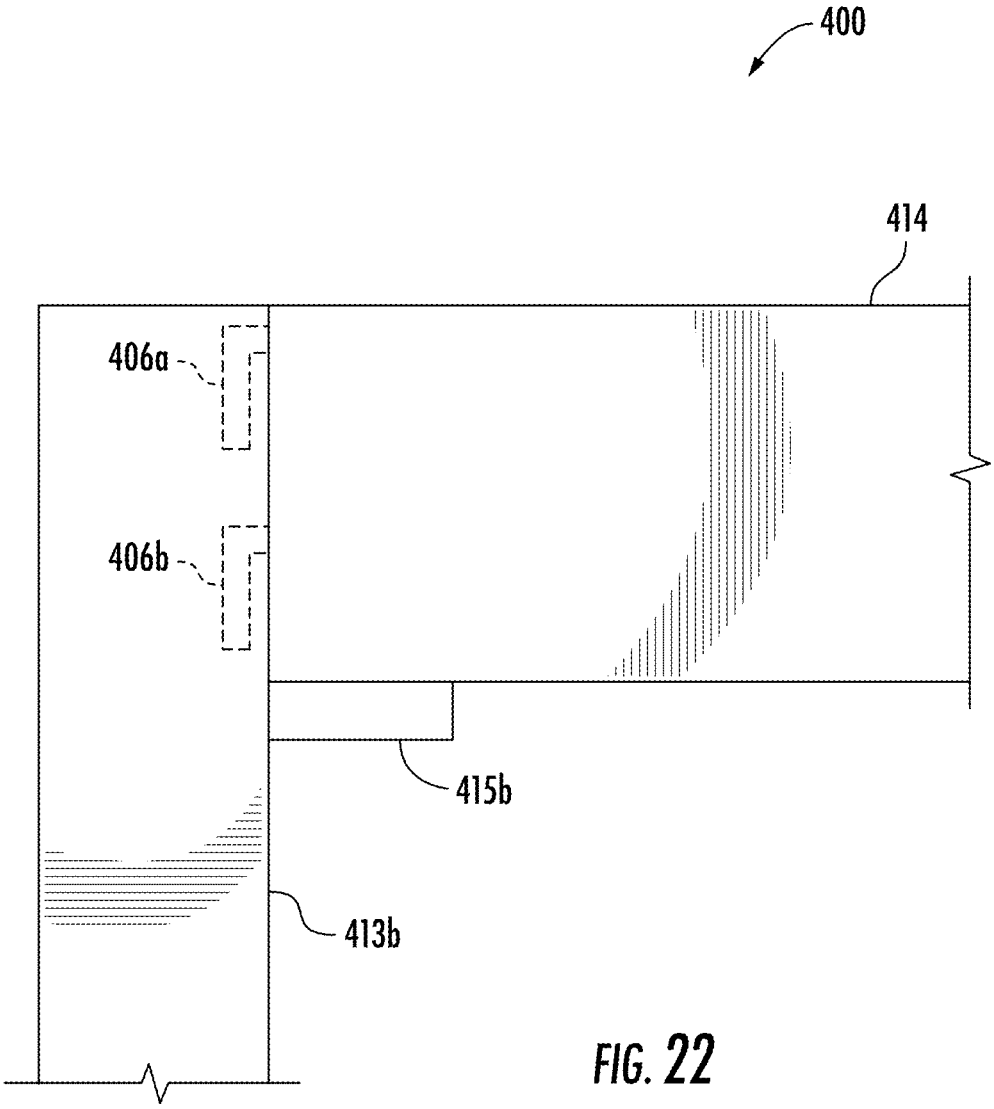
FIG. 22 is a partial view of adjacent components from the table assembly of FIG. 20.

Referring now additionally to FIGS. 20-22, a table assembly 400 according to the present disclosure is now described. The table assembly 400 illustratively includes first and second leg assemblies 413*a*-413*b*, and a tabletop 414 coupled to the first and second leg assemblies. The table assembly 400 illustratively includes first and second connection devices 403*a*-403*b* coupling the first and second leg assemblies 413*a*-413*b* to the tabletop 414. Each of the first and second connection devices 403*a*-403*b* illustratively comprises first and second L-shaped connection pieces 406*a*-406*b* extending from the tabletop 414 and into first and second openings in the first and second leg assemblies 413*a*-413*b*. Further, the table assembly 400 illustratively comprises a plurality of closable fasteners 415*a*-415*d* (e.g., recloseable fasteners such as illustrated C-clamps) coupling the first and second leg assemblies 413*a*-413*b* to the tabletop 414. As will be appreciated, the plurality of closable fasteners 415*a*-415*d* is to secure the coupling and prevent unintended dislodgement.

Figure 23:
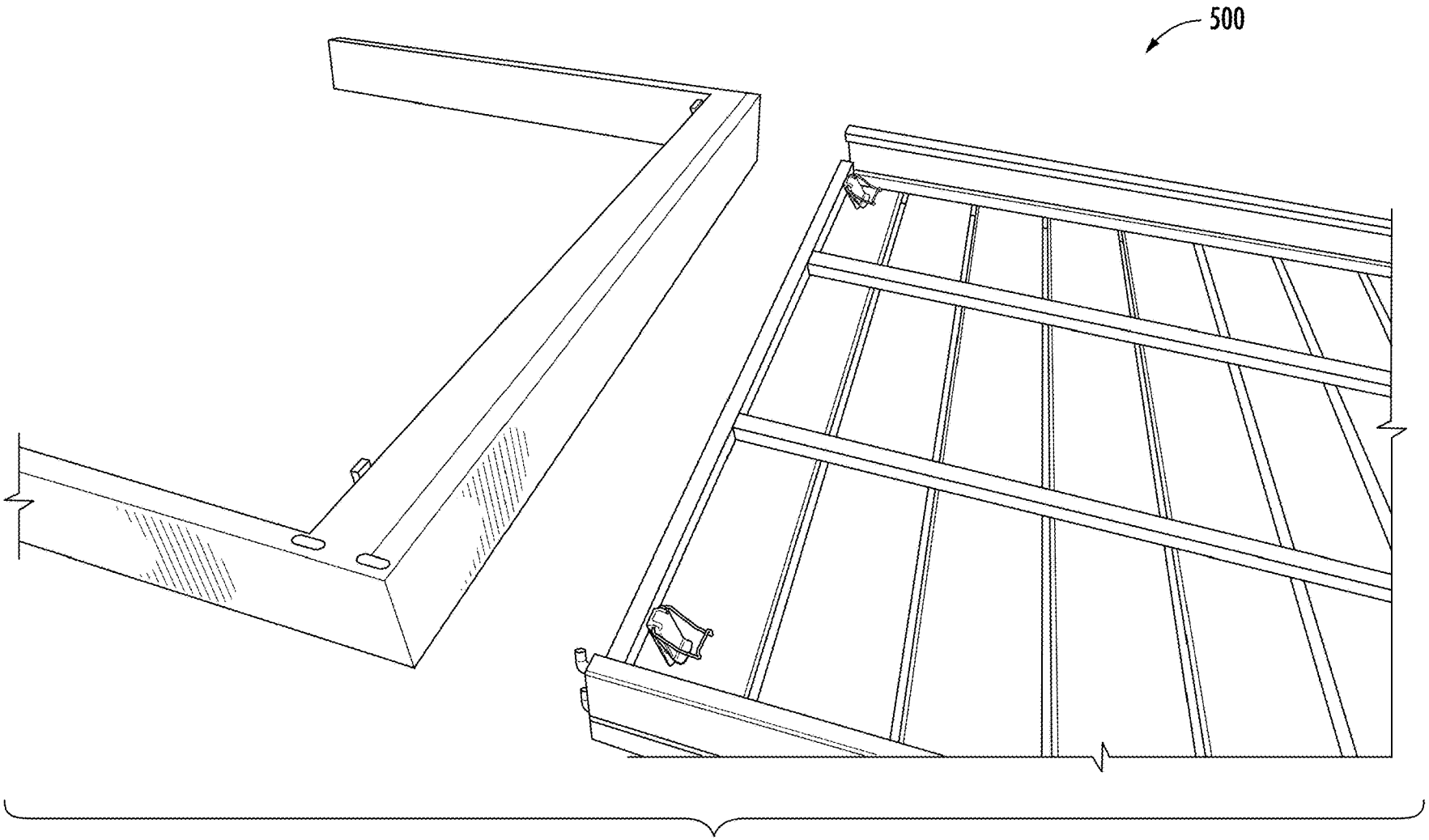
FIG. 23 is a perspective view of a second example embodiment of a table assembly, according to the present disclosure.

Referring now additionally to FIG. 23, another embodiment of the table assembly 500 is now described. In this embodiment of the table assembly 500, those elements already discussed above with respect to FIGS. 20-22 are incremented by 100 and most require no further discussion herein. This embodiment differs from the previous embodiment in that this table assembly 500 illustratively is for a full length rectangle-shaped table.

It should be appreciated that features of the first example embodiment of the chair assembly 100 may be combined with features of the second example embodiment of the chair assembly 200 or the third example embodiment of the chair assembly 300 and vice versa. Also, it should be appreciated that the assembly features of the chair assembly 100, 200, 300 may be applied to other furniture pieces, such as a tables (FIGS. 20-23), stools, etc.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A chair assembly comprising:
first and second arm rests;
a backboard;
a pair of first connection devices coupling the backboard between the first and second arm rests;
a seat board; and a pair of second connection devices coupling the seat board between the first and second arm rests;
each first connection device comprising
a first L-shaped anchor,
a second transverse anchor comprising an elongate anchor extending through one of the first and second arm rests and the backboard and a housing receiving the elongate anchor and coupled to the one of the first and second arm rests and the backboard, and
first and second openings opposite to and receiving the first L-shaped anchor and the second transverse anchor for coupling;
each second connection device comprising
a third L-shaped anchor, and
a third opening opposite to and receiving the third L-shaped anchor for coupling.

2. The chair assembly of claim 1 wherein the first L-shaped anchor is canted at an angle with respect to the first and second arm rests and the backboard.

3. The chair assembly of claim 2 wherein the angle is oblique.

4. The chair assembly of claim 1 wherein the elongate anchor is L-shaped.

5. The chair assembly of claim 1 wherein the first opening and the third opening each comprises an elongate opening; and wherein the second opening comprises a circle-shaped opening.

6. The chair assembly of claim 1 wherein the first and second arm rests, the backboard, and the seat board are hollow.

7. The chair assembly of claim 1 wherein the first and second arm rests, the backboard, and the seat board comprises a metallic material.

8. A chair assembly comprising:
first and second arm rests;
a backboard;
a pair of first connection devices coupling the backboard between the first and second arm rests;
a seat board; and
a pair of second connection devices coupling the seat board between the first and second arm rests;
each first connection device comprising
a first L-shaped anchor,
a second transverse anchor, the first L-shaped anchor being canted at an angle less than 15° with respect to the first and second arm rests and the backboard, and
first and second openings opposite to and receiving the first L-shaped anchor and the second transverse anchor for coupling;
each second connection device comprising
a third L-shaped anchor, and
a third opening opposite to and receiving the third L-shaped anchor for coupling.

9. The chair assembly of claim 8 wherein the second transverse anchor comprises an elongate anchor extending through one of the first and second arm rests and the backboard.

10. The chair assembly of claim 9 wherein the second transverse anchor comprises a housing coupled to one of the first and second arm rests and the backboard and receiving the elongate anchor.

11. The chair assembly of claim 9 wherein the first opening and the third opening each comprises an elongate opening, the second opening comprising a circle-shaped opening; and wherein the elongate anchor is L-shaped.

12. The chair assembly of claim 8 wherein the first and second arm rests, the backboard, and the seat board are hollow.

13. The chair assembly of claim 8 wherein the first and second arm rests, the backboard, and the seat board comprises a metallic material.

14. A method for making a chair assembly to be assembled by a user, the method comprising:
providing first and second arm rests and a backboard;
forming a pair of first connection devices to be coupled between the backboard and the first and second arm rests;
providing a seat board; and
forming a pair of second connection devices to be coupled between the seat board and the first and second arm rests;
each first connection device comprising a
first L-shaped anchor,
a second transverse anchor comprising an elongate anchor extending through one of the first and second arm rests and the backboard and a housing receiving the elongate anchor and coupled to the one of the first and second arm rests and the backboard, and first and second openings opposite to and receiving the first L-shaped anchor and the second transverse anchor for coupling;

each second connection device comprising a third L-shaped anchor, and a third opening opposite to and receiving the third L-shaped anchor for coupling.

15. The method of claim 14 wherein the first L-shaped anchor is canted at an angle with respect to the first and second arm rests and the backboard.

16. The method of claim 14 wherein the elongate anchor is L-shaped.

17. The method of claim 15 wherein the angle is less than 15°.

18. The method of claim 14 wherein the first opening and the third opening each comprises an elongate opening; and wherein the second opening comprises a circle-shaped opening.

19. The method of claim 14 wherein the first and second arm rests, the backboard, and the seat board are hollow.

20. The method of claim 14 wherein the first and second arm rests, the backboard, and the seat board comprises a metallic material.

* * * * *